US010072827B2

(12) United States Patent
Clark et al.

(10) Patent No.: US 10,072,827 B2
(45) Date of Patent: Sep. 11, 2018

(54) LIGHT ART SEAM EFFECTS AND HARDWARE

(71) Applicant: 3form, LLC, Salt Lake City, UT (US)

(72) Inventors: W. Bruce Clark, Redmond, WA (US); Caleb L. Patterson, Seattle, WA (US)

(73) Assignee: 3Form, LLC, Salt Lake City, UT (US)

( * ) Notice: Subject to any disclaimer, the term of this patent is extended or adjusted under 35 U.S.C. 154(b) by 88 days.

(21) Appl. No.: 14/912,396

(22) PCT Filed: Nov. 14, 2014

(86) PCT No.: PCT/US2014/065816
§ 371 (c)(1),
(2) Date: Feb. 16, 2016

(87) PCT Pub. No.: WO2015/073907
PCT Pub. Date: May 21, 2015

(65) Prior Publication Data

US 2016/0245488 A1 Aug. 25, 2016

Related U.S. Application Data

(60) Provisional application No. 61/905,176, filed on Nov. 16, 2013.

(51) Int. Cl.
*F21V 21/005* (2006.01)
*F21S 2/00* (2016.01)

(52) U.S. Cl.
CPC ..... *F21V 21/005* (2013.01); *F21S 2/00* (2013.01); *F21S 2/005* (2013.01)

(58) Field of Classification Search
CPC ..... F21S 2/005; F21V 21/005
USPC ..... 362/219, 217.17
See application file for complete search history.

(56) References Cited

U.S. PATENT DOCUMENTS

D97,213 S 11/1869 Stone
D101,033 S 3/1870 Glatthar et al.
(Continued)

FOREIGN PATENT DOCUMENTS

JP 2003217332 7/2003
JP 2011159472 8/2011
(Continued)

OTHER PUBLICATIONS

Notice of Allowance for U.S. Appl. No. 29/560,673 dated Nov. 13, 2017.
(Continued)

*Primary Examiner* — Laura Tso
(74) *Attorney, Agent, or Firm* — Workman Nydegger

(57) ABSTRACT

A lighting fixture can be configured to display reduced visibility of seams and hardware when illuminated. At the junction site between lighting modules of a modular lighting assembly, support hardware can be positioned within corresponding recesses in the respective coupling ends of the connected lighting modules. An outer element can also be wrapped around the respective outer edges of the coupling ends and partially into the junction site adjacent to the support hardware. Connective seams between the wrapped outer edges and support hardware at the junction between lighting modules can thus be de-emphasized when adjacent lighting elements are activated. Multiple, different shaped modules can be combined to create light fixtures of different shapes.

22 Claims, 22 Drawing Sheets

(56) References Cited

U.S. PATENT DOCUMENTS

| | | | | |
|---|---|---|---|---|
| D101,034 | S | 3/1870 | Glatthar et al. | |
| D136,518 | S | 3/1873 | Hofstetter | |
| D166,671 | S | 8/1875 | Jernigan | |
| 1,335,613 | A | 3/1920 | Cuno | |
| 1,963,218 | A | 6/1934 | Wakefield | |
| 3,385,963 | A | 5/1968 | Washick | |
| D264,136 | S | 4/1982 | Castiglioni | |
| 4,555,114 | A | 11/1985 | Dozier | |
| 4,716,671 | A | 1/1988 | Gross | |
| 4,726,781 | A * | 2/1988 | Bernhart | F21V 21/005 362/219 |
| 4,799,526 | A | 1/1989 | Reeves | |
| 5,226,724 | A | 7/1993 | Kanarek | |
| D338,620 | S | 8/1993 | Brozowski | |
| 5,282,600 | A * | 2/1994 | Weiss | F21S 2/00 248/343 |
| 5,532,073 | A | 7/1996 | Hirata | |
| 5,658,066 | A * | 8/1997 | Hirsch | F21V 21/005 362/219 |
| D387,459 | S | 12/1997 | Cool | |
| 5,702,180 | A | 12/1997 | Huang | |
| D391,881 | S | 3/1998 | Youseph | |
| 5,947,786 | A | 9/1999 | Glick | |
| D416,103 | S | 11/1999 | Hashmi | |
| 5,989,015 | A | 11/1999 | Guerin | |
| D431,187 | S | 9/2000 | Davis | |
| D432,868 | S | 10/2000 | Tan | |
| D438,858 | S | 3/2001 | del Castillo | |
| 6,302,566 | B1 | 10/2001 | Cohon | |
| 6,341,880 | B1 | 1/2002 | Hsu | |
| 6,530,674 | B2 * | 3/2003 | Grierson | F21V 21/005 362/219 |
| D508,580 | S | 8/2005 | Norris et al. | |
| 6,964,507 | B2 | 11/2005 | Mohacsi | |
| 6,984,055 | B2 * | 1/2006 | McCarthy | F21S 2/00 362/219 |
| D523,328 | S | 6/2006 | Ramos | |
| D523,771 | S | 6/2006 | Kwan | |
| D525,384 | S | 7/2006 | Waycaster | |
| D525,738 | S | 7/2006 | Waycaster | |
| D536,468 | S | 2/2007 | Crosby | |
| D541,970 | S | 5/2007 | Blackman | |
| D544,006 | S | 6/2007 | Pinchot | |
| D559,994 | S | 1/2008 | Nagakubo | |
| D566,320 | S | 4/2008 | Kim | |
| 7,380,957 | B2 * | 6/2008 | Lanczy | F21V 21/005 362/219 |
| 7,504,159 | B1 | 3/2009 | Suare | |
| D591,444 | S | 4/2009 | Beno et al. | |
| D592,793 | S | 5/2009 | Chandler | |
| D595,888 | S | 7/2009 | Sabernig | |
| D596,452 | S | 7/2009 | Komorski | |
| D600,394 | S | 9/2009 | Ambruster | |
| D603,083 | S | 10/2009 | Trumble | |
| D605,333 | S | 12/2009 | Miranda | |
| 7,766,536 | B2 | 8/2010 | Peifer | |
| D628,218 | S | 11/2010 | Tommassini | |
| D641,520 | S | 7/2011 | Grajcar | |
| D653,794 | S | 2/2012 | Friedman | |
| D665,525 | S | 8/2012 | Patterson | |
| D666,354 | S | 8/2012 | Bracher | |
| D667,986 | S | 9/2012 | Decq | |
| D668,371 | S | 10/2012 | Alpasian | |
| D669,759 | S | 10/2012 | Catilleja | |
| D671,676 | S | 11/2012 | Komarov | |
| D676,587 | S | 2/2013 | Fisher | |
| D676,996 | S | 2/2013 | Gismondi | |
| D684,294 | S | 6/2013 | Goodson | |
| D686,363 | S | 7/2013 | Smith | |
| D687,589 | S | 8/2013 | Wick | |
| 8,517,845 | B2 | 8/2013 | Shin | |
| D692,391 | S | 10/2013 | Kim | |
| D697,662 | S | 1/2014 | Patterson | |
| D698,983 | S | 2/2014 | Rampolla | |
| 8,714,775 | B2 | 5/2014 | Bracher | |
| D708,391 | S | 7/2014 | Coury | |
| D709,235 | S | 7/2014 | Chu | |
| RE45,162 | E | 9/2014 | Hierzer | |
| D716,486 | S | 10/2014 | Martin | |
| D728,145 | S | 4/2015 | Shiqiang | |
| D729,437 | S | 5/2015 | Hillstrom | |
| D744,132 | S | 11/2015 | Hollingworth | |
| D745,206 | S | 12/2015 | Clark | |
| D760,420 | S | 6/2016 | Tomlinson | |
| D761,478 | S | 7/2016 | Ng | |
| D761,990 | S | 7/2016 | Ng | |
| D761,991 | S | 7/2016 | Clark | |
| D761,992 | S | 7/2016 | Ng | |
| D764,095 | S | 8/2016 | Clark | |
| 9,441,807 | B2 | 9/2016 | Smith | |
| D768,905 | S | 10/2016 | Sonneman | |
| D768,906 | S | 10/2016 | Sonneman | |
| D773,099 | S | 11/2016 | Sonneman | |
| D774,239 | S | 12/2016 | Pardo | |
| D783,197 | S | 4/2017 | Amdt | |
| D786,481 | S | 5/2017 | Wiedemer | |
| 9,644,820 | B2 | 5/2017 | Clark | |
| D791,385 | S | 7/2017 | Sonneman | |
| D791,401 | S | 7/2017 | Sonneman | |
| D792,006 | S | 7/2017 | Sonneman | |
| D792,633 | S | 7/2017 | Sonneman | |
| D797,977 | S | 9/2017 | Farzan | |
| D797,982 | S | 9/2017 | Sonneman | |
| 2001/0046621 | A1 | 11/2001 | Colli | |
| 2004/0027830 | A1 | 2/2004 | Chen | |
| 2008/0314944 | A1 | 12/2008 | Tsai | |
| 2010/0149791 | A1 | 7/2010 | McCane et al. | |
| 2011/0170294 | A1 | 7/2011 | Mier-Langner | |
| 2012/0081919 | A1 | 4/2012 | Parker | |
| 2013/0094225 | A1 | 4/2013 | Leichner | |
| 2014/0022759 | A1 | 1/2014 | Li | |
| 2014/0198494 | A1 | 7/2014 | Lextar | |
| 2014/0334178 | A1 | 11/2014 | Zharov | |
| 2015/0300605 | A1 | 10/2015 | Clark | |
| 2016/0245488 | A1 | 8/2016 | Clark | |
| 2016/0281940 | A1 | 9/2016 | Kim | |
| 2017/0138561 | A1 | 5/2017 | Van Strander | |

FOREIGN PATENT DOCUMENTS

| | | |
|---|---|---|
| KR | 2020100007653 | 7/2010 |
| KR | 2020120007760 | 11/2012 |
| KR | 101454180 | 10/2014 |
| WO | 2013006790 | 1/2013 |
| WO | 2013058961 | 4/2013 |
| WO | 2014081621 | 5/2014 |
| WO | 2015073907 | 5/2015 |
| WO | 2015184156 | 12/2015 |

OTHER PUBLICATIONS

Notice of Allowance for U.S. Appl. No. 15/076,852 dated Oct. 11, 2017.

Non-Final Office Action for U.S. Appl. No. 29/530,073 dated Sep. 1, 2017.

Office Action for U.S. Appl. No. 29/560,681 dated Jun. 15, 2017.

Modern Square LED Chandelier Lighting (available online Sep. 22, 2015) Retrieved from the internet Jun. 2, 2017, retrieved from the internet URL: https://www.amazon.com/VONN-VMC31620AL-Chandelier-Lighting-Adjustable/dp/B015OG45GE/ref=sr_1_2?ie=UTF8&qid=1498172914&sr=8-2&keywords=Modern+Square+LED+Chandelier+Lighting.

Modern Two-Tier LED Chandelier (available online Sep. 22, 2015) Retrieved from the internet Jun. 2, 2017, retrieved from the internet URL: https://www.amazon.com/VONN-VMC31710SW-Two-Tier-Chandelier-Adjustable/dp/B0150G4J8S/ref=pd_sbs_60 2?_encoding=UTF8&pd_rd_i=B0150G4J8S&pd_rd_r=9GZ57EM9VFSJZMQW1ERC&pd_rd_w=XsCRS&pd_rd_wg=VbWDy&psc=1&refRID=9GZ57EM9VFSJZ.

(56) References Cited

OTHER PUBLICATIONS

Astro D-Light wall Light (available online) Retrieved from the internet Jun. 2, 2017, retrieved from the internet URL: https://www.lovelights.co.uk/led-lighting-c17/astro-d-light-led-wall-light-p22295.
International Search Report and Written Opinion for PCT/US14/65816 dated Feb. 19, 2015.
Office Action in U.S. Appl. No. 29/560,673 dated May 10, 2017.
Light art (available online Oct. 21, 2013) Retrieved from the internet Mar. 16, 2017, retrieved from the internet URL: www.youtuve.com (search "Lightart.com".
Tin eye reference (available online Oct. 8, 2014) Retrieved from the internet Mar. 23, 2017, retrieved from the internet URL: https://tineye.com/search/cb9bd08581564e1b2247fa8b78f73b92f57cc422/ Reference internet site URL: https://www.architonic.com/en/product/henge-light-ring-medium/1149533.
Ring shade 32 LED Pendant (available online Mar. 28, 2015) Retrieved from the internet Apr. 8, 2017, retireved from the internet URL: https://web-beta.archive.org/web/20150328234600/http://www.sonnemanawayoflight.com/ringshade32ledpendant-p-922.html.
Light In The Box (available online Dec. 30, 2014) Retrieved from the internet Mar. 16, 2017, retrieved from the Internet URL: https://www.amazon.com/LightInTheBox-RingHome-Chandeliers-Lighting-110-120V/dp/B00RL1N79W/ref=pd_bxgy_60_img_3?_encoding=UTF8&pd_rd_i=B00RL1N79W&pd_rd_r=0K15VB464BCF6J7RV59C&pd_rd_w=3rhz3&pd_rd_wg=r71Jv&psc=1&refRID=0K15VB4.
International Search Report & Written Opinion for application No. PCT/US14/65816 dated Feb. 19, 2015.
International Search Report & Written Opinion for application No. PCT/US2015/033014 dated Sep. 8, 2015.
International Search Report & Written Opinion for application No. PCT/US2013/070236 dated Mar. 11, 2014.
Office Action in U.S. Appl. No. 14/767,890 dated May 12, 2017.
Office Action in U.S. Appl. No. 14/646,232 dated Dec. 15, 2016.
Ex Parte Quayle Action for U.S. Appl. No. 29/481,765 dated May 9, 2016.
Ex Parte Quayle Action for U.S. Appl. No. 29/545,539 dated May 23, 2016.
Office Action for U.S. Appl. No. 29/481,765 dated Oct. 16, 2015.
Requirement for Restriction for U.S. Appl. No. 29/530,073 dated May 30, 2017.
Office Action for U.S. Appl. No. 14/646,232 dated May 2, 2016.
Final Office Action for U.S. Appl. No. 14/767,890 dated Dec. 29, 2017.
Non-Final Office Action for U.S. Appl. No. 29/560,686 dated Jan. 9, 2018.
The807, (Feb. 5, 2014), [online], [site visited Jan. 4, 2018]. Available from internet <URL: Retrieved from https://www.etsy.com/uk/listing/176582577/triangle-shadow-box-set-of-3?ref=related-2>.
Non-Final Office Action for U.S. Appl. No. 29/560,688 dated Jan. 9, 2018.
EONeyeofnature. (Jan. 5, 2015), [online], [site visited Jan. 4, 2018]. Available from internet, <URL: Retireved from https://www.etsy.com/uk/listing/217343723/set-of-four-hexagon-honeycomb-shelves-in?show_sold_out_detail=1>.
Search Report for application No. GB1715859.3 dated Mar. 8, 2018.
Non-Final Office Action for U.S. Appl. No. 14/767,890 dated Jun. 4, 2018.

* cited by examiner

LIGHT ART SEAM EFFECTS AND HARDWARE

CROSS-REFERENCE TO RELATED APPLICATIONS

The present invention is a 35 U.S.C. § 371 U.S. National Stage of PCT Application No. PCT/US14/065816, filed on Nov. 14, 2014, which claims priority to U.S. Provisional Patent Application No. 61/905,176, filed Nov. 16, 2013. The entire content of each of the aforementioned patent applications is incorporated herein by reference.

BACKGROUND

Technical Field

This disclosure relates to systems, methods, and apparatus for providing illumination.

Background and Relevant Art

Recent trends in building design involve using one or more sets of decorative panels to add to the functional and/or aesthetic characteristics of a given structure or design space. In particular, the use of resin-based panels is becoming increasingly popular in lighting applications. Such resin materials may be manufactured to be more resilient and to have a similar transparent, translucent, or decorative appearance as cast or laminated glass, but with less cost. In addition, resin-based materials tend to be more flexible and versatile in terms of manufacture and assembly as they can be relatively easily bent, molded, colored, textured, shaped, gauged, cut, and otherwise modified in a variety of different ways and can provide a larger variety of colors, images, interlayers, shapes, and impact resistance than can glass.

Certain resin-based lighting applications involve the coupling of multiple smaller lighting modules to form a larger modular lighting assembly. One drawback to such modular lighting systems includes the unsightly gap or seam between two lighting modules at the site of coupling, as well as shadows, dark spots, and/or other unsightly byproducts or consequences of the design, manufacturing, and/or assembling process(es). Seams and/or features of this sort may detract from the aesthetic appeal of the lighting element. Furthermore, modular lighting concepts often include connective and other support or mounting hardware that is visible and aesthetically unappealing.

Accordingly, there are a number of disadvantages in resin-based lighting fixtures that can be addressed.

BRIEF SUMMARY

Implementations of the present disclosure solve one or more of the foregoing or other problems in the art with systems, methods, and apparatus for improving the modularity and/or connectivity of various light fixture sub-components, all the while reducing and/or with reduced visibility of various features, components, and/or connection point(s) therebetween. For example, one or more implementations of the present disclosure include systems, methods, and apparatus for reduced and/or reducing visibility of seams and/or hardware of resin-based lighting fixtures, such as when the lighting fixture is illuminated.

Additional features and advantages of exemplary implementations of the present disclosure will be set forth in the description which follows, and in part will be obvious from the description, or may be learned by the practice of such exemplary implementations. The features and advantages of such implementations may be realized and obtained by means of the instruments and combinations particularly recited in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1A:
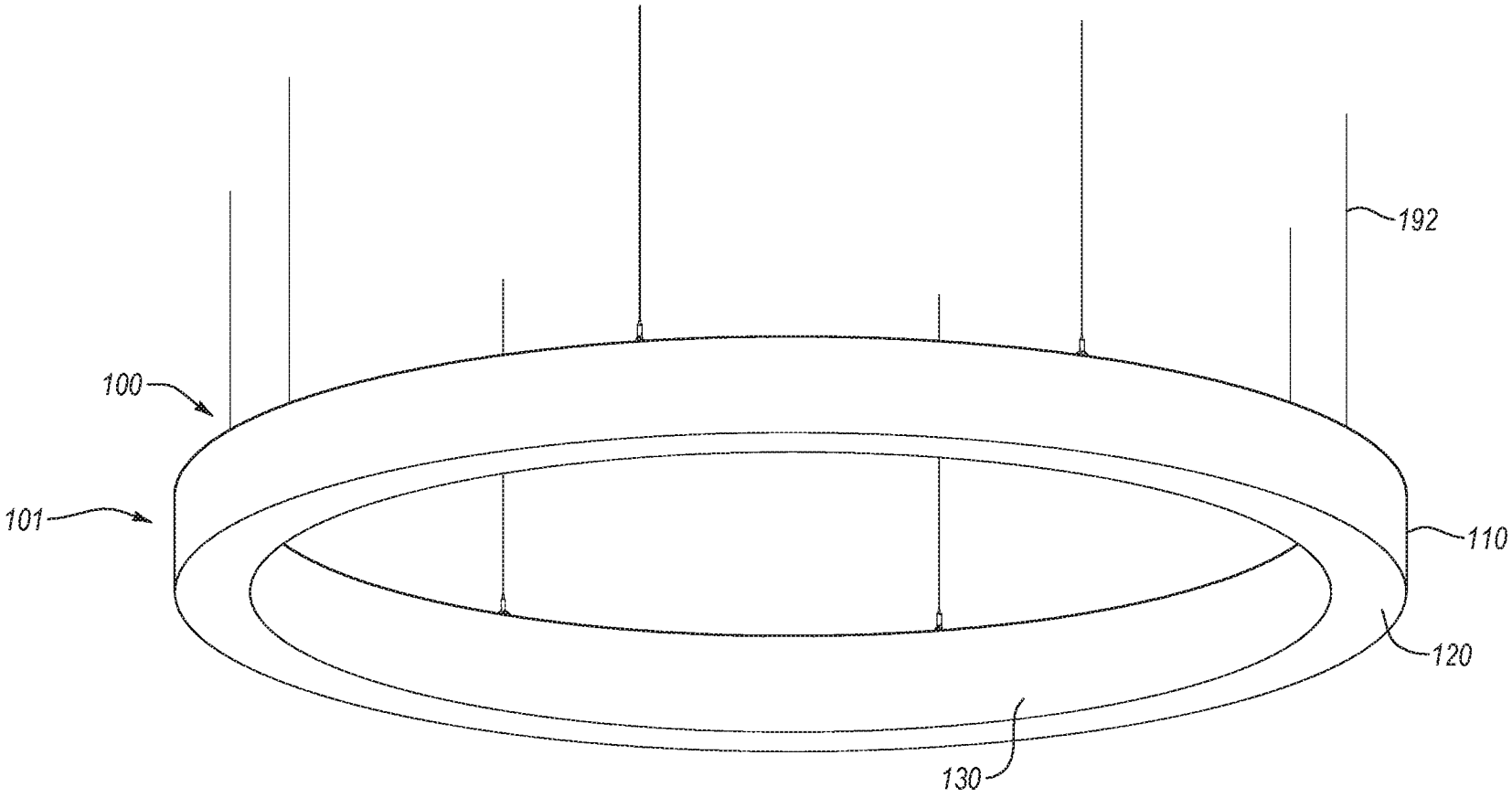
FIG. 1A illustrates a bottom perspective view of an illuminated lighting fixture in accordance with an implementation of the present disclosure.

Before describing the present disclosure in detail, it is to be understood that this disclosure is not limited to parameters of the particularly exemplified products, processes, kits, and/or methods, which may, of course, vary. It is also to be understood that the terminology used herein is only for the purpose of describing particular embodiments of the present disclosure, and is not intended to limit the scope of the disclosure in any manner.

Additionally, the terms "including," "having," "involving," "containing," "characterized by," and variants thereof (e.g., "includes," "has," and "involves," "contains," etc.) as used herein, including the claims, shall be inclusive and/or open ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the content clearly dictates otherwise. Thus, for example, reference to a "vertical support" includes one, two, or more vertical supports.

As used in the specification and appended claims, directional terms, such as "top," "bottom," "left," "right," "up," "down," "upper," "lower," "outer," "inner," "proximal," "distal," and the like are used herein solely to indicate relative directions and are not otherwise intended to limit the scope of the disclosure or claims. Similarly, terms such as "horizontal," "vertical," "lateral," and the like are used herein solely to indicate relative orientation and are not otherwise intended to limit the scope of the disclosure or claims.

Where possible, like numbering of elements have been used in various figures. Furthermore, multiple instances of an element and or sub-elements of a parent element may each include separate letters appended to the element number. For example two instances of a particular element "111" may be labeled as "111*a*" and "111*b*". In that case, the element label may be used without an appended letter (e.g., "111") to generally refer to instances of the element or any one of the elements. Element labels including an appended letter (e.g., "111*a*") can be used to refer to a specific instance of the element or to distinguish or draw attention to multiple uses of the element. Furthermore, an element label with an appended letter can be used to designate an alternative design, structure, function, implementation, and/or embodiment of an element or feature without an appended letter. Likewise, an element label with an appended letter can be used to indicate a sub-element of a parent element.

Various aspects of the present devices and systems may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present. Furthermore, as used herein, the terms "connection," "connected," and the like do not necessarily imply direct contact between the two or more elements.

Various aspects of the present disclosure may be illustrated with reference to one or more exemplary embodiments. As used herein, the term "exemplary" means "serving as an example, instance, or illustration," and should not necessarily be construed as preferred or advantageous over other embodiments disclosed herein.

It will also be appreciated that where a range of values (e.g., less than, greater than, at least, or up to a certain value, or between two recited values) is disclosed or recited, any specific value or range of values falling within the disclosed range of values is likewise disclosed and contemplated herein.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only example materials and methods are described herein.

Implementations of the present disclosure involve systems, methods, and apparatus for improving the modularity and/or connectivity of various light fixture sub-components, all the while with reduced and/or reducing visibility of various features, components, and/or connection point(s) therebetween. For example, one or more implementations of the present disclosure include systems, methods, and apparatus for reduced and/or reducing visibility of seam(s) and/or hardware of resin-based lighting fixtures, such as when the lighting fixture is illuminated.

One or more implementations of the present disclosure include resin-based modular lighting fixtures that reduce or eliminate the visibility of connective seams and/or hardware at the coupling interface between lighting modules. Additionally, one or more implementations of the present disclosure include a method of reducing or eliminating the visibility connective seams and/or hardware at the coupling interface between lighting modules of resin-based modular lighting fixtures. Furthermore, one or more implementations of the present disclosure include a system for displaying resin-based modular lighting fixtures with reduced or eliminated visibility of connective seam(s) and/or hardware at the coupling interface between lighting modules.

Specifically, the visibility of seams and/or hardware can be reduced and/or eliminated from at least one vantage point when the lighting fixture is illuminated (e.g., as compared to an unilluminated state and/or when the lighting fixture is unilluminated). As used herein, "illuminated," "on," "turned on," and similar terms refer to the operation of one or more lighting elements, members, assemblies, and/or mechanisms associated with the lighting fixture. Those skilled in the art will appreciate that the one or more lighting elements, members, assemblies, and/or mechanisms associated with the lighting fixture can be disposed and/or positioned proximal to the lighting fixture. For instance, a lighting element can be connected to, mounted on, and/or positioned within a portion of the lighting element. In at least one implementation, the lighting element is disposed and/or positioned within 2 cm, 5 cm, 10 cm, 15 cm, 20 cm, 30 cm, 40 cm, 50 cm, 60 cm, 70 cm, 80 cm, 90 cm, or 100 cm of the seam(s) and/or hardware. Accordingly, the lighting element can shine light (directly) on the seam(s), hardware, and/or other component(s) of the lighting fixture (thereby reducing or eliminating visibility of the seam(s) and/or hardware from at least one vantage point).

It will be appreciated that while reference is made to "lighting fixtures," "lighting assemblies," "lighting modules," and the like, the present disclosure is not so limited. For instance, some implementations can include a decorative, ornamental, or other design feature unassociated with lighting and/or illumination. In at least one implementation, a lighting fixture comprises an ornamental design fixture and/or assembly that does not include, contain, or comprise an attached or otherwise associated lighting element. Furthermore, some implementations may involve one or more external, removed, and/or unassociated lighting elements or sources. At least one implementation may rely upon ceiling-mounted or recessed lighting fixtures or elements to provide illumination. Other implementations may involve ambient light, sun light, moon light, and/or reflection(s) thereof. Still other implementations operate by principles entirely or substantially independent of lighting elements, fixtures, or sources.

In certain implementations, the lighting fixture can include or otherwise be formed from one or more flexible panels. Such panels can be thermoformed (i.e., thermal formed using heat to render the panel pliable, moldable, or otherwise able to be shaped) or cold-formed (i.e., without additional heating) into a desired shape during assembly and/or formation of the lighting fixture. Moreover, such flexible panels can combine or be combined together to form various three-dimensional shapes as can be desired by an assembler or installer. For example, multiple flexible panels can couple or be coupled together to form a substantially cylindrical or ring shaped lighting fixture. Likewise, flexible panels can couple or be coupled together to form rectangular or other shaped lighting fixtures.

Figure 1B:
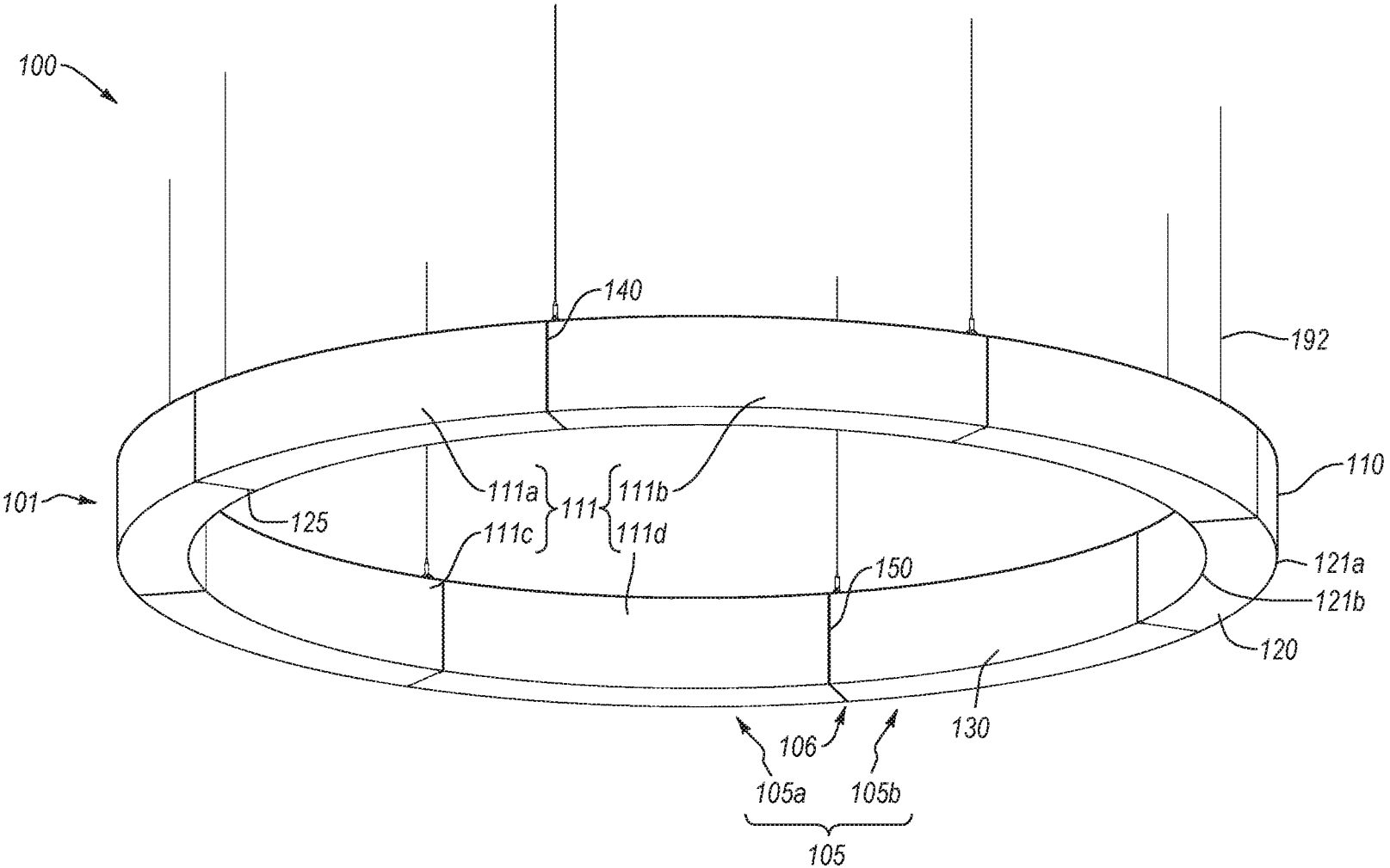
FIG. 1B illustrates a bottom perspective view of an un-illuminated lighting fixture of FIG. 1A.

FIGS. 1A and 1B illustrate bottom perspective views of a lighting fixture 100 in accordance with an implementation of the present disclosure. As illustrated in FIG. 1A, lighting fixture 100 can have an outer element or shade 110 wrapped around or positioned about the side or exterior surface of the lighting fixture. One will appreciate, however, that outer element or shade 110 can also or alternatively cover other portions of lighting fixture 100 and can include a plurality of outer elements, shades, or other components. In at least one implementation, the outer element or shade 110 can have or be formed into a substantially cylindrical shape. Likewise, a lighting fixture 100 may comprise any suitable shape, including a rectangular block, a tubular conduit, or any geometric shape compatible with lighting fixtures or assemblies. As illustrated in FIG. 1A, for example, lighting fixture 100 comprises a ring-shaped structure 101. Thus, an outer element or shade 110 can comprise any geometric shape necessary to cover at least a portion of an exterior surface of the lighting fixture 100.

In certain implementations, outer element or shade 110 can comprise an opaque material configured to substantially block, prevent, obstruct, shade, reduce, or impede light from passing therethrough. One will appreciate, however, that outer element 110 can alternatively include transparent or translucent material configured to allow the at least some light to pass therethrough. Likewise, outer element 110 may disperse, soften, reduce, or alter the appearance of the light without departing from the scope of this disclosure. In certain implementations, the outer element 110 comprises an aesthetic covering or display for at least one surface of the lighting fixture 100.

Furthermore, outer element or shade 110 can include first and second surfaces. The outer display surface, especially, of outer element or shade 110 can be colored, shaded, textured, or otherwise modified in a variety of different ways and can provide a larger variety of images, designs, and other aesthetically pleasing enhancements. For instance, outer element or shade 110 can be accessorized, ornamented, decorated, or otherwise modified with decorative features including natural or naturally occurring, synthetic or manufactured, or a combination of objects resembling flowers, trees, celestial bodies, animals, bodies of water, shapes, or any other suitable item. Furthermore, certain types of ink, stain, and/or other additions or layers can be provided for decorative and/or ornamental purposes without departing from the scope of this disclosure.

In at least one implementation, the outer element 110 (or other components, elements, and/or features disclosed herein) can comprise a resin or other flexible panel material. For instance, the outer element 110 can comprise a resin, co-polyester, or thermoplastic sheet material. As used herein, the terms "resin panel," "resin material," and the like refer to a panel, film, sheet, or other element comprising a substrate of one or more layers formed from any one of the following thermoplastic polymers (or alloys thereof). Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), or the like.

In other implementations, outer element 110 (or other components, elements, and/or features disclosed herein) can comprise fabric, paper, of other material whether synthetic, naturally-occurring, or a combination thereof. For instance, outer element 110 can comprise a composite material including recycled and/or post-consumer product(s).

In at least one implementation, the resin or other material of outer element 110 can be configured as a rigid or semi-rigid structural component of the lighting fixture 100 or can be formed or otherwise situated around or about an interior structural element. Furthermore, outer element 110 can comprise any suitable thickness or gauge compatible with covering or otherwise enhancing a lighting fixture 100. For example, the gauge or thickness of the outer element 110 in at least one implementation can be anywhere from about one two hundred and fifty-sixth inch (1/256"), or thinner to about one inch (1"), or thicker. In at least one implementation, the gauge or thickness of the outer element 110 can be approximately one-eighth inch (1/8"), one-sixteenth inch (1/16"), or one-thirty second inch (1/32"). One will appreciate, however, that paper-thin gauge outer elements, block-thick out elements, and/or any suitable gauge or thickness can be suitable and/or appropriate in certain implementations.

Likewise, the length, height, circumference, and/or other dimensions of outer element 110, as well as the radius (of curvature) or diameter for outer elements (of ring-shaped structure 101, for example) can comprise any suitable size, shape, or measurement. For instance, in at least one implementation, outer element 110 may have a height of approximately one foot (1') or less, while other implementations can include an outer element 110 with a height greater than about one foot (1'). One will appreciate that other elements, components, features, and/or members disclosed herein can correspond in or to the length, height, circumference, and/or other dimensions of outer element 110, or may be different, including greater or smaller.

In addition, outer element 110 can comprise any suitable length (e.g., the circumference in a ring-shaped structure 101). Illustratively, a lighting fixture 100 comprising a ring-shaped structure 101 having a diameter of approximately twelve feet (12') can include an outer element 110 having a length or circumference of approximately 75 feet or more. One will appreciate, however, that lighting fixtures of all shapes and sizes, including diameters of ten feet (10'), eight feet (8'), six feet (6') or less, as well as fourteen feet (14'), sixteen feet (16'), eighteen feet (18') or more are contemplated herein. Furthermore, outer element 110 can comprise a plurality of outer element segments, modules, or other units. In particular, outer element segments can be joined, coupled, connected, or otherwise combined to form an outer element 110 of any suitable, required, desirable, and/or conceivable size.

Lighting fixture 100 can also have a bottom portion or panel 120 coupled to the outer element or shade 110. Bottom portion or panel 120 can comprise one or more thermoplastic sheets or panels, such as acrylic (e.g., PMMA), PETG, PC, or another polymer, or can comprise another suitable, versatile material. One will appreciate that a bottom portion or panel 120 can also comprise a plurality of bottom portion or panel segments. In one or more implementations, the bottom portion of the lighting fixture is configured to permit light to pass at least partially therethrough. For instance, the bottom portion may diffuse, disperse, soften, reduce, or otherwise alter the light emitted from a lighting element installed within the lighting fixture 100. Bottom panel 120 can also or alternatively comprise a single panel or sheet of translucent material (e.g., thermoplastic, glass). One will appreciate, however, that a bottom portion can alternatively include transparent or opaque material without departing from the scope of this disclosure.

In certain implementations, the size, shape, length, curvature, configuration, and/or other measurement(s) or feature(s) of bottom portion or panel 120 can correspond to the measurement(s) and/or feature(s) of one or more outer elements or shades 110. For instance, an outer element or shade 110 (or segment thereof) may have a length substantially similar to bottom portion or panel 120 (or segment thereof) such that the outer element or shade 110 (or segment thereof) substantially covers a side portion of the bottom portion or panel 120 (or segment thereof). In other implementations, however, an outer element or shade 110 (or segment thereof) may have a length substantially similar to two (2) bottom portions or panels 120 (or segments thereof) such that the outer element or shade 110 (or segment thereof) substantially covers side portions of two (2) adjacent bottom portions or panels 120 (or segments thereof). Likewise, a bottom portion or panel 120 (or segment thereof) may have a length substantially similar to two (2) outer elements or shades 110 (or segments thereof) such that the two (2) outer elements or shades 110 (or segments thereof) substantially cover a bottom portion or panel 120 (or segment thereof).

Furthermore, bottom panel 120 may diffuse the light emitted by or from the lighting fixture 100 (or element(s) thereof) as the light passes through the bottom panel 120. For instance, the bottom panel 120 may optionally include a background layer. Particularly, the bottom panel 120 can have a background layer or coating that can diffuse the light as the light passes through the bottom panel 120. The background layer can comprise a translucent film, a translucent paint, or other coating which can be applied to the front and/or back surfaces of the bottom panel 120. Additionally or alternatively, the bottom panel 120 can have a surface roughness or other features that can deflect and/or diffuse light produced and/or emitted by the lighting fixture or an element thereof. Thus, the bottom panel 120 may act as one or more diffusors to help evenly distribute light.

In some implementations, the bottom portion or panel 120 provides a structural component of or for the lighting fixture 100 or components thereof. For instance, bottom portion or panel 120 can be configured to structurally support, retain, or hold outer element or shade 110 in a desired shape and/or orientation or provide a structure or other substrate about or around which the outer element can be situated or otherwise positioned. For instance, as illustrated in FIG. 1A, outer element 110 is wrapped around the circular, closed-loop, and/or ring-shaped structure 101 including bottom portion or panel 120 such that outer element 110 adopts a circular, cylindrical, and/or ring-shaped configuration. Similarly, an outer element 110 can be wrapped around or positioned about a rectangular or other shaped bottom portion or panel 120 such that the outer element 110 conforms to the shape of the bottom portion or panel 120 and/or covers at least a portion of one or more surfaces of the lighting fixture 100.

Lighting fixture 100 can also have an inner element or shade 130 opposite the outer element or shade 120. One will appreciate that while the ring-shaped structure 101 of lighting fixture 100 is configured for both inner and outer elements, other structures may not be so configured. For instance, at least one implementation includes a circular, disc-shaped bottom portion with a surface that covers the area within the dimensions of the outer element such that no inner element is required, needed, or desirable for aesthetic and/or structural purposes. Such a lighting fixture 100 may resemble a solid cylinder, disc, saucer, or other geometric shape without an open portion in the middle thereof. In one or more implementations, outer element 110 and inner element 130 can be comprised of the same material(s). For instance, both elements can comprise a panel of resin, thermoplastic, co-polyester, or other such material.

In at least one implementation, bottom portion or panel 120, outer element or shade 110, and/or inner element or shade 130 may at least partially conceal from view one or more lighting elements or components (e.g., light bulbs or LEDs; not shown) housed or otherwise positioned within the lighting fixture 100. Importantly, as illustrated in FIG. 1A, the lighting fixture 100 is illuminated by the one or more lighting elements or components (not shown) such that visibility of various elements of lighting fixture 100 are eliminated, reduced, or otherwise de-emphasized relative to the un-illuminated state (see e.g., FIG. 1B).

In one or more implementations, lighting fixture 100 may have a modular configuration. As illustrated in FIG. 1B, lighting fixture 100 can include a plurality of lighting modules 105 such as, for example, lighting modules 105*a* and 105*b*. Thus, in certain implementations, lighting fixture 100 can comprise a modular lighting fixture or assembly. Modular lighting assemblies allow for much larger lighting fixtures than could otherwise be provided in a cost effective manner. For instance, while many, if not all of the components and elements of lighting fixtures can be manufactured in relatively large sizes, transport and installation of such large, bulky components can be cumbersome and expensive. Thus, the use of a plurality of (smaller) lighting modules to form a (larger) modular lighting assembly can enhance both simplicity and affordability.

Additionally or alternatively, modularity of the lighting fixture may facilitate so called "just-in-time" manufacturing. In other words, a manufacturer can assemble the lighting fixture after receiving an order or making a sale. Consequently, in lieu of storing fully assembled lighting fixtures, the manufacturer can store more portable components thereof (e.g., flexible panels), which can occupy less storage space and can be easily assembled into lighting fixtures of various shapes on demand.

In at least one implementation, lighting fixture 100 can include a plurality of lighting modules 105 coupled together at an interface 106. In some implementations, one or more module or segment ends (not shown) of the lighting modules 105 can be configured as a coupling end or interface. In certain implementations, the segment end(s) (not shown) can include a segment end piece, element, or member (not shown) configured to be coupled with a segment end piece, element, or member of a second lighting module. Thus, a plurality of lighting modules can be coupled, segment end-to-segment end to form a modular lighting fixture 100.

In at least one implementation, the lighting modules 105 can be formed in a variety of shapes and sizes. For instance, an illustrative lighting module 105*a*, 105*b* can be formed in or as an arc, or arch-shaped, module 105*a*, 105*b*. In certain implementations, the coupling together of such arc, or arch-shaped, modules 105*a*, 105*b* may form a ring structure 101. For instance, when a plurality of rectangular cross-section, arc- or arch-shaped modules are connected end-to-end in the same orientation (i.e., modules of the same handedness of curvature or angle), the resulting structure may loop around, connecting the end of a final module 105*b* to the end of the first module 105*a* at the interface 106.

One will appreciate that use of the terms first, subsequent, intermediate, final, and/or last, etc. relative to ring or other shaped structures (whether forming a continuous, closed-loop structure or a structure having terminal ends) is illustrative only. For example, while technically indistinguishable in a continuous ring structure, the arbitrary designations of first, intermediate, and/or last modules (based on the order of placement or some other determinative) are useful for instructive, illustrative, or other referential purpose(s). In any case, lighting modules can be coupled to one or more additional modules to form a continuous, closed-loop lighting fixture or can be connected or coupled so as to form a structure having one or more terminal ends.

In addition to ring-shaped lighting fixtures including or otherwise formed of rectangular cross-section, arc- or arch-shaped lighting modules, ring-shaped lighting fixtures including or otherwise formed of tubular and/or other geometric cross-sectioned, arc- or arch-shaped lighting modules are contemplated herein. Furthermore, a variety of smooth or rounded angles or edges, as well as sharp angled configurations are also contemplated herein. For instance, certain modules can include acute, obtuse, or right angle(s) or angled edges. Likewise, certain modules can include rounded edges having a variety of radii of curvatures, respectively. For instance, an illustrative arrangement of ring-shaped lighting fixtures can include ring-shaped structures of various sizes (see e.g., FIGS. 6A and 6B). In at least one implementation, each ring-shaped fixture of the arrangement has a different radius.

Furthermore, in one or more implementations, ring or otherwise shaped lighting fixtures can be formed in a variety of shapes and sizes by combining various modules described herein. For example, arc- or arch-shaped modules may have a wave-like configuration such that coupling of multiple modules together in the same orientation (i.e., modules of the same handedness of curvature or angle) results in a waving or oscillating ring or other structure. Alternatively, modules can be coupled in an opposite orientation (i.e., modules of opposite handedness of curvature or angle) to form complex, winding or angled structures.

In at least one implementation, the lighting fixture 100 can include one or more seams at the junction between first and second portions of the lighting fixture. As illustrated in FIG. 1B, seams 140, 150, 125 can be formed at the connective junction or coupling interface 106 between first and second lighting modules 105 (e.g., 105*a* and 105*b*) in a modular lighting fixture 100. Specifically, the seam can be formed at the connective junction or coupling interface 106 between the respective outer elements 110 (see e.g., seam 140), inner elements 130 (see e.g., seam 150), and/or bottom portions 120 (see e.g., seam 125) of two or more lighting modules 105. In an alternative implementation, the seam can be formed at the connective junction or coupling interface 106 between first and second ends of a single outer element 110 wrapped around the lighting structure. In any event, the visibility of the seam can be reduced and/or eliminated when the lighting fixture 100 is illuminated (see e.g., FIG. 1A); relative to an un-illuminated state illustrated in FIG. 1B. Thus, a lighting fixture having and/or displaying reduced visibility of at least one seam is provided.

Figure 1C:
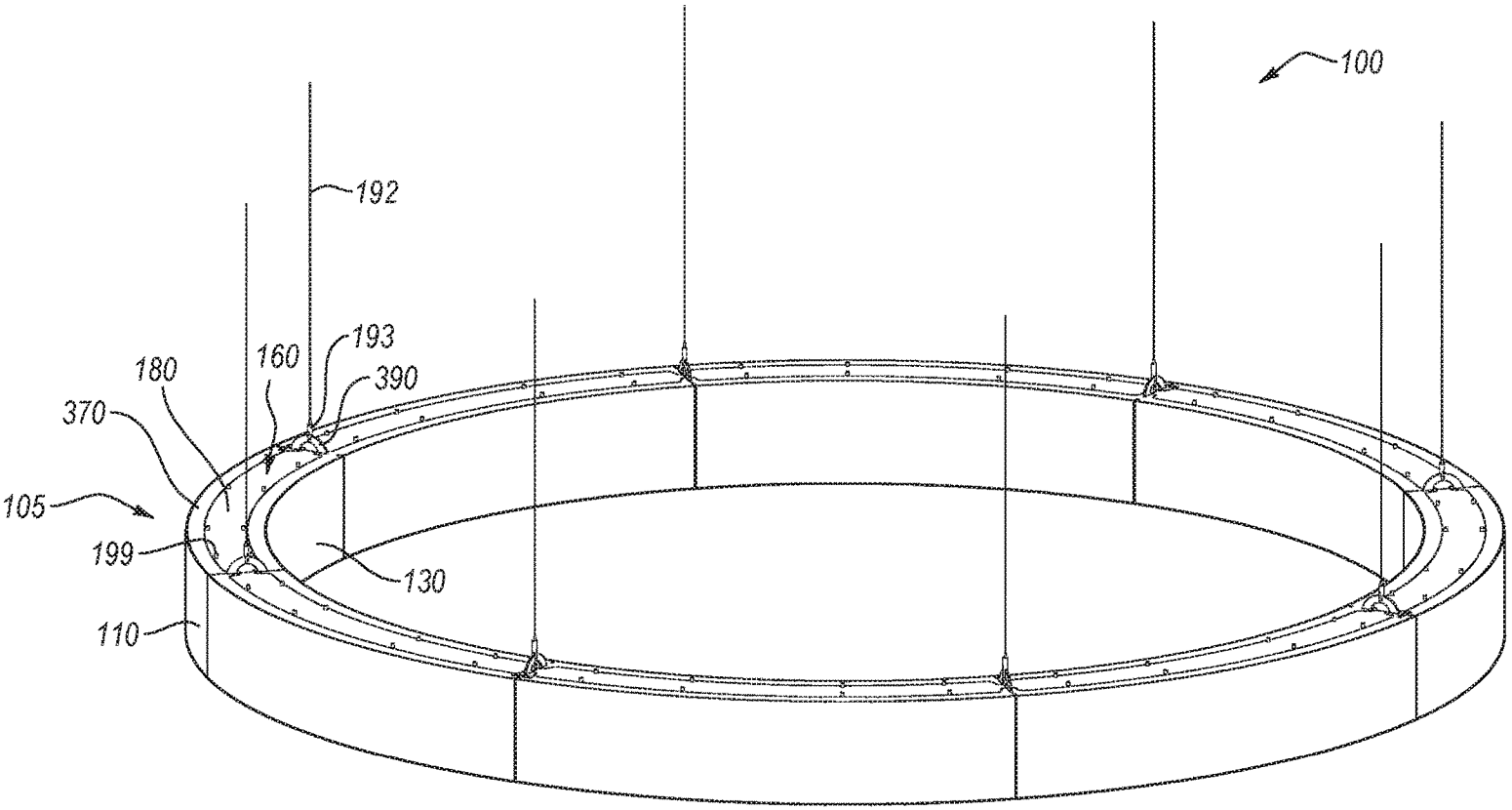
FIG. 1C illustrates a top perspective view of an un-illuminated lighting fixture of FIG. 1A.

FIG. 1C illustrates a top perspective view of the un-illuminated lighting fixture of FIG. 1B. Lighting fixture 100 can be suspended from a support structure via one or more cables 192. Cables 192 can be connected to suspension or mounting bracket 390 via one or more attachment members 193. Attachment member 193 can be pivotably connected to bracket 390 such that lighting fixture 100 can be oriented in any suitable orientation relative to the support structure to which it is mounted or suspended.

As illustrated in FIG. 1C, lighting fixture 100 can include a plurality of lighting modules 105. Lighting module 105 can include an outer element 110, an inner element 130, and an upper assembly 160 disposed therebetween. As will be discussed in further detail below, upper assembly 160 can include an upper portion or top element 370 and/or a lighting assembly or cover 180. Upper portion or top element 370 can be connected to lighting assembly or cover 180 via fastener 199.

Figure 2A:
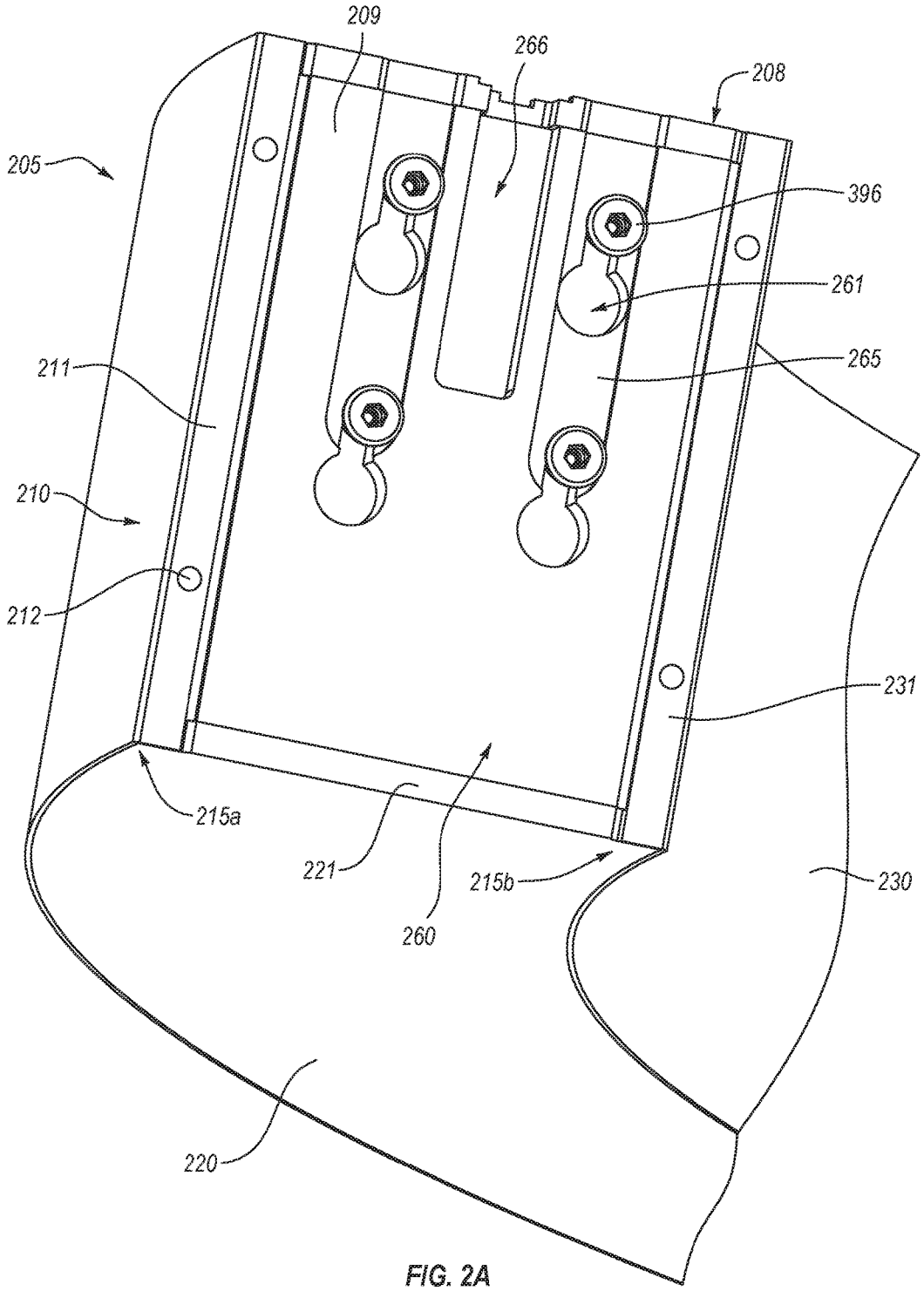
FIG. 2A illustrates an end perspective view of a lighting module in accordance with an implementation of the present disclosure.
Figure 2B:
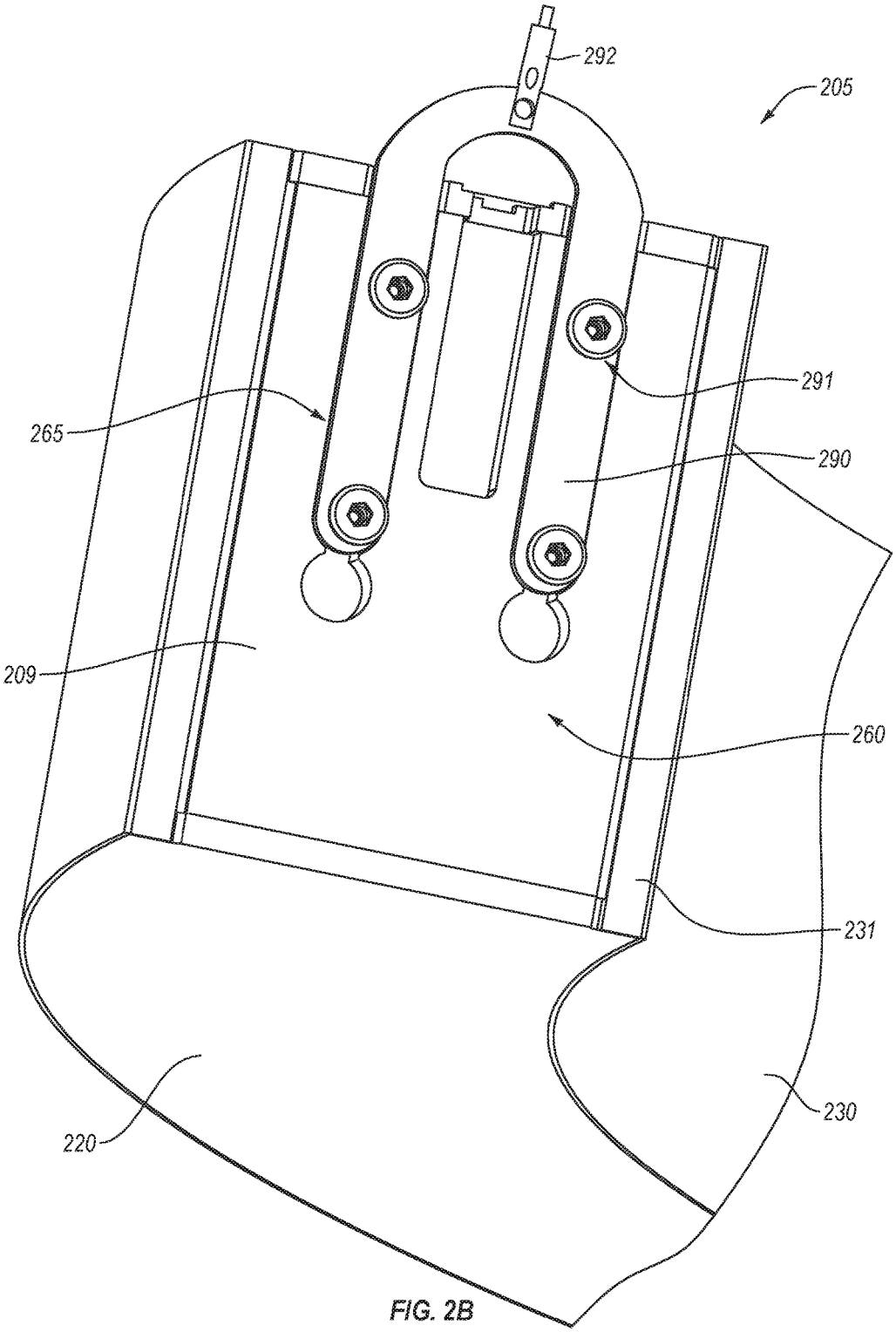
FIG. 2B illustrates an end perspective view of a lighting module in accordance with another implementation of the present disclosure.

FIGS. 2A and 2B illustrate end perspective views of a lighting module in accordance with an implementation of the present disclosure. For instance, FIG. 2A illustrates a segment end 208 of a lighting module 205 having an outer element 210, a bottom portion 220, an inner element 230, and a segment end member 209, wherein segment end member 209 comprises an outer or coupling face or surface 260. In at least one implementation, segment end member 209 can be positioned at one end of bottom portion 220 such that at least a portion of outer or coupling face or surface 260 is substantially flush with facial end 221 of bottom portion 220.

Furthermore, bottom portion 220 and/or segment end member 209 (or coupling face or surface 260 thereof) can have an outer coupling edge 215*a* and/or an inner coupling edge 215*b* about or around which outer element 210 and/or inner element 230 can be wrapped, bent, folded, positioned, formed, or otherwise configured. Specifically, outer element 210 and/or inner element 230 can be wrapped, bent, folded, positioned, or otherwise configured around or about outer coupling edge 215*a* and/or an inner coupling edge 215*b* such that flange(s) 211 and 231 are formed. In some implementations, flange(s) 211 and 231 protrude or otherwise extend partially into or adjacent to the region or area of coupling face or surface 260 of segment end member 209.

In one or more implementations, lighting module 205 can be configured such that an outer surface of flange(s) 211 and 231 is substantially flush with segment end member 209 (or coupling face or surface 260 thereof) and/or bottom portion 220 (or facial end 221 thereof). For instance, segment end member 209 and/or bottom portion 220 may respectively have routed, rabbited, or otherwise recessed portions configured at or in the coupling interface surface adjacent to outer coupling edge 215*a* and/or to inner coupling edge 215*b* such that flange(s) 211 and 231 are retained or otherwise positioned within the respective recesses.

In at least one implementation, the recessed portion(s) correspond substantially to the thickness of outer element 210 (or flange 211 thereof) and/or inner element 230 (or flange 231 thereof) such that the outer surface of flange(s) 211 and 231 are substantially flush with the coupling interface surface, segment end member 209 (or coupling face or surface 260 thereof) and/or bottom portion 220 (or facial end 221 thereof). Thus, the recessed portion(s) can comprise a one-sixteenth inch (1/16") reduction in depth relative to the coupling interface surface, segment end member 209 (or coupling face or surface 260 thereof) and/or bottom portion 220 (or facial end 221 thereof). Alternatively, lighting module 205 can be configured such that flange(s) 211 and 231 are elevated or raised relative to the coupling interface surface, segment end member 209 (or coupling face or surface 260 thereof) and/or bottom portion 220 (or facial end 221 thereof).

In some implementations, flange(s) 211 and 231, segment end member 209 (or coupling face or surface 260 thereof) and/or bottom portion 220 (or facial end 221 thereof) may have one or more coupling holes, perforations, apertures, slots, openings, or other formations. For instance, flange(s) 211 and 231 may have one or more coupling holes 212. In certain implementations, corresponding coupling holes can be found in segment end member 209 (or coupling face or surface 260 thereof) and/or bottom portion 220 (or facial end 221 thereof), or the recessed portions thereof.

In at least one implementation, coupling holes 212 can be configured to receive one or more fasteners such that flange(s) 211 and 231 can be coupled to coupling segment end member 209 (or coupling face or surface 260 thereof) and/or bottom portion 220 (or facial end 221 thereof) via coupling holes 212 by means of one or more fasteners. Flange(s) 211 and 231 may further or alternatively be coupled to segment end member 209 (or coupling face or surface 260 thereof) and/or bottom portion 220 (or facial end 221 thereof) with an adhesive or solvent such that flange(s) 211 and 231 can be bonded, fused, or otherwise attached to segment end member 209 (or coupling face or surface 260 thereof) and/or bottom portion 220 (or facial end 221 thereof). In at least one implementation, flange(s) 211 and 231 can be held securely in place by one or more clamps or other securing member while the adhesive bonds or otherwise attaches flange(s) 211 and 231 to segment end member 209 (or coupling face or surface 260 thereof) and/or bottom portion 220 (or facial end 221 thereof), or recessed portions thereof.

Similarly, segment end member 209 (or coupling face or surface 260 thereof) may have one or more coupling holes 261 configured to receive at least one fastener 396 such that lighting module 205 can be coupled to a second lighting module (not shown) via coupling holes 261 by means of the fastener(s). In certain implementations, lighting module 205 may further be coupled to a second lighting module (not shown) with an adhesive or solvent such that lighting module 205 can be bonded or otherwise attached to the second lighting module (not shown).

Additionally, segment end member 209 (or coupling face or surface 260 thereof) can comprise one or more additional recesses or recessed areas. For example, coupling surface 260 may have a recess 265 substantially centered between outer coupling edge 215*a* and inner coupling edge 215*b*. Furthermore, recess 265 can be open at a top end, opposite or distal to bottom portion 220, and closed at a bottom end adjacent or proximal to bottom portion 220. Moreover, recess 265 can include a substantially rectangular top end and a rounded bottom end. One will appreciate, however, that such a configuration is illustrative only, and that the present disclosure is not so limited. Indeed, recessed areas according to various implementations of the present disclosure can be configured in any suitable orientation, position, shape, and/or size.

Recess 265 can also include one or more holes, perforations, apertures, slots, openings, or other formations. For instance, recess 265 can include opening 266 positioned substantially in the center of coupling surface 260, between outer coupling edge 215*a* and inner coupling edge 215*b*, and between first and second side walls of recess 265. In certain implementations, opening 266 can be configured to receive one or more fasteners (not shown) for coupling lighting module 205 (or a portion thereof; e.g., coupling surface 260) to at least a second lighting module (not shown). Specifically, coupling surface 260 of lighting module 205 can interface with the coupling surface of a second lighting module in a modular lighting fixture or assembly (see e.g., modular lighting fixture 100 illustrated in FIG. 1B).

In at least one implementation, recess 265 can be configured to receive a mounting or other bracket. For instance, as illustrated in FIG. 2B, mounting bracket 290 can be situated or positioned at least partially within recess 265. Bracket 290 can correspond substantially to the shape and size of recess 265. Recess 265 can also be configured to receive a plurality of mounting or other brackets without departing from the scope of this disclosure. In certain implementations, bracket 290 has one or more holes, perforations, apertures, slots, openings, or other formations. For instance, bracket 290 includes a plurality of openings 291. In certain implementations, opening 291 can be configured to receive one or more fasteners (not shown) for coupling bracket 290 into recess 265 of coupling surface 260 of segment end piece 209 in lighting module 205. One will appreciate, however, that a bracket 290 can be coupled to other portions, components, or areas of lighting module 205 without departing from the scope of this disclosure.

In some implementations, bracket 290 can comprise metal or an alloy thereof. Furthermore, bracket 290 can be coated with a powder coating paint or other material for aesthetic and/or functional enhancement. Specifically, bracket 290 can be powder coated white or another light spectrum color such that light emitted by or from the lighting fixture can be refracted more efficiently than by a bracket having a metallic or other surface or coating. In at least one implementation, coating of bracket 290 further reduces the visibility of various elements of the lighting fixture, including one or more seams and/or brackets.

In certain implementations, bracket 290 can include or have attached, articulated, or otherwise joined thereto one or more support structure attachment members 292. For instance, support structure attachment members 292 can comprise a cable-gripper or other attachment or coupling mechanism configured to suspend the lighting element (or module 205 thereof) from a ceiling (see e.g., FIGS. 1A-1C) via a cable (for example, cable 192 illustrated in FIGS. 1A-1C). One will appreciate, however, that lighting fixtures according to various implementations of the present disclosure can be mounted, coupled, suspended, or otherwise attached to a wall, floor, ceiling, partition, divider, sub-floor, elevated floor, suspended ceiling, or any other suitable support structure.

Figure 3A:
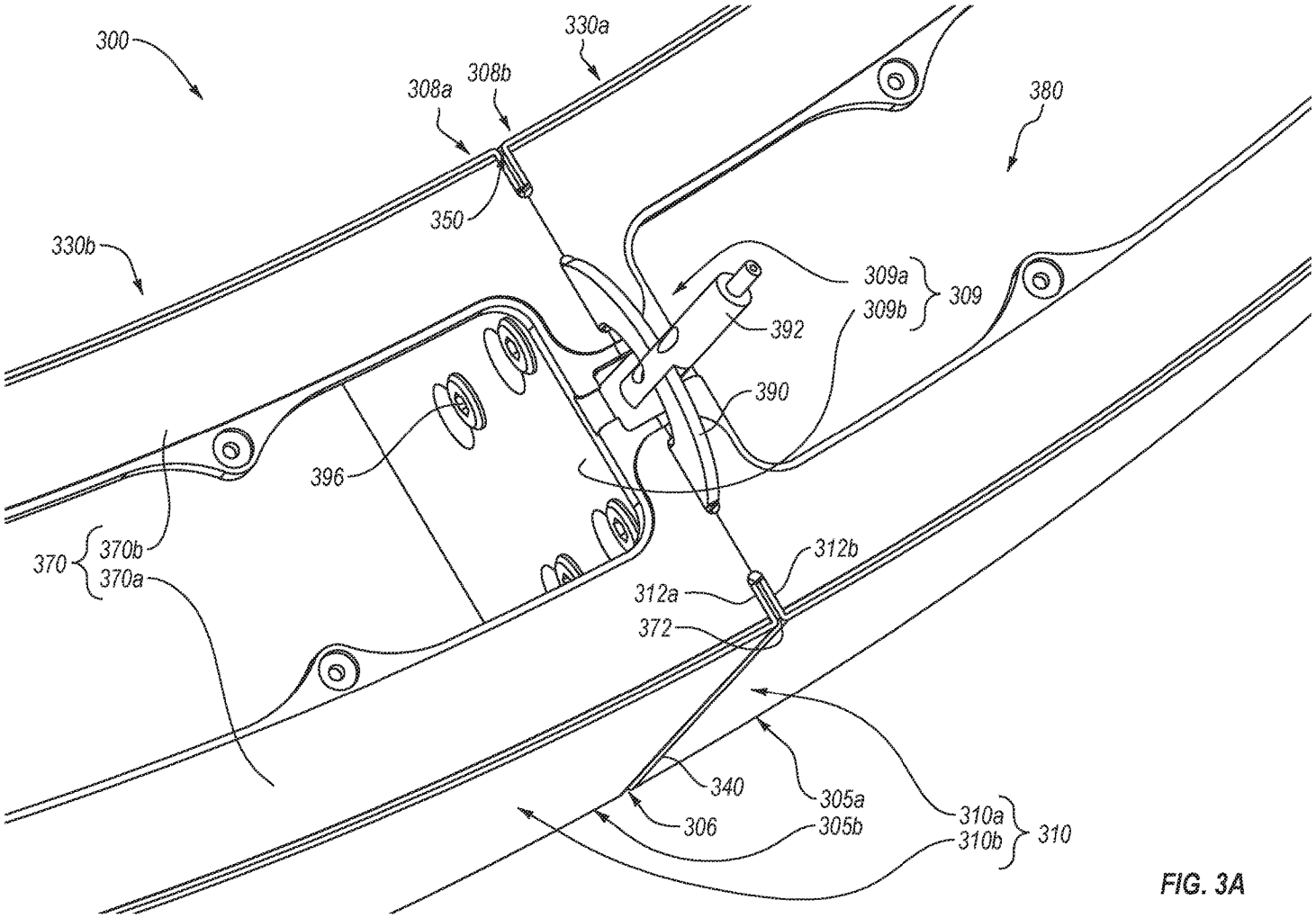
FIG. 3A illustrates a top perspective view of a coupling junction between two lighting modules in accordance with an implementation of the present disclosure.

FIG. 3A illustrates a top perspective view of a coupling junction between two lighting modules 305*a* and 305*b* of a modular lighting fixture 300 in accordance with an implementation of the present disclosure. As illustrated in FIG. 3A, lighting modules 305*a* and 305*b* can be coupled together at junction or interface 306. Illustratively, segment end member 309*a* (or the outer or coupling face or surface thereof) at the segment end 308*a* of lighting modules 305*a* can be coupled to segment end member 309*b* (or the outer or coupling face or surface thereof) at the segment end 308*b* of lighting modules 305*b* at junction or interface 306 to form a connective junction assembly (or end piece assembly) 309. In at least one implementation, lighting modules 305*a* and 305*b* can be coupled via one or more fasteners 396. A more detailed description of connection junction assembly (or and piece assembly) 309 will be given hereafter in connection with FIGS. 4A-4C.

In one or more implementations, outer element or shade 310*a* of module 305*a* and/or outer element or shade 310*b* of module 305*b* can be wrapped or otherwise positioned around segment end member(s) 309*a*, 309*b* such that flange(s) 312*a* and/or 312*b* are formed. Flange(s) 312*a* and/or 312*b* may extend, at least partially into the region of junction or interface 306 between segment end member(s) 309*a*, 309*b*. Furthermore, a seam 340 can be formed at the outer edge of junction or interface 306 between segment end member(s) 309*a*, 309*b*. As discussed previously, an inner element or shade of a lighting module can be wrapped or otherwise positioned around the segment end member(s) 309*a*, 309*b* such that one or more inner flanges are formed. The inner flange(s) may extend, at least partially into the region of junction or interface 306 between segment end member(s) 309*a*, 309*b*. Furthermore, a seam 350 can be formed at the inner edge of junction or interface 306 between segment end member(s) 309*a*, 309*b*.

In some implementations, lighting fixture 300 can also include one or more top panels or elements 370 positioned in an upper portion of lighting fixture 300. Top panels or elements 370 may couple or attach to the outer element or shade 310. The top panel 130 can also provide additional rigidity to the lighting fixture 300 and can further enclose any lighting elements thereof (not shown). As further described below, the top panel 370 can also facilitate attachment of various mounting features and elements, which can allow an installer to secure the lighting fixture 300 to a support surface.

Furthermore, at least a portion of top element 370 can be configured to attach, adhere, rest, or otherwise connect to the upper edge of one or more segment end members 309*a*, 309*b*. Specifically, top element 370 may have one or more support members 371 configured to attach, adhere, rest, or otherwise connect to the upper edge of one or more segment end members 309*a*, 309*b*. Some implementations can include a plurality of top elements 370; for example, top elements 370*a* and 370*b*. Specifically, an illustrative lighting fixture 300 comprising a ring-shaped structure can comprise one or more outer top elements and/or one or more inner top elements 370*b*. Alternatively, one or more top elements 370 may attach, adhere, rest, or otherwise connect to the upper edge of both inner and outer regions of the lighting fixture 300.

In certain implementations, top element 370 can comprise one or more notches or ticks. For example, outer top element 370*a* may have one or more notches 372. Notch 372 can be configured to receive flange 312*a* and/or flange 312*b* therein. Thus, notch 372 receives flanges 312*a* and 312*b*, and at least partially prevents or inhibits the same from becoming uncoupled, unconnected, or otherwise unassociated.

In at least one implementation, top element 370 may not protrude above outer element or shade 310*a*, 310*b*. For example, an upper surface of top element 370 can be positioned so as to be flush with an upper surface of outer element or shade 310*a*, 310*b*. Thus, outer element or shade 310*a*, 310*b* may substantially conceal from view at least a portion of top element 370 from a first vantage point.

In at least one implementation, top element or panel 370 may diffuse the light emitted by or from the lighting fixture 300, as the light passes therethrough. Particularly, top panel 370 can comprise the same (or same type) material as the bottom panel 120 (see e.g., FIG. 1A). For instance, top panel 370 can comprise a thermoplastic sheet, such as acrylic (e.g., PMMA), PETG, PC or another polymer. Additionally, the top panel 370 can optionally include a background layer. The background layer can comprise a translucent film, a translucent paint, or other coating which can be applied to the front and/or back surfaces of the top panel 370. Additionally or alternatively, bottom panel 370 can have a surface roughness or other features that can deflect and diffuse the light emitted by the lighting elements. Thus, top panel 370 (and/or the bottom panel 120) can act as diffusors to help evenly distribute light.

In one or more implementations, lighting fixture 300 can also comprise a channel, void, cavity, passageway, opening, or other hollow or semi-hollow region. For example, lighting fixture 300 can have an inner cavity or passageway 380 between or defined by the inner elements or shade(s) 330*a*, 330*b* and out element(s) or shade(s) 310*a*, 310*b*. Inner cavity 380 can be further defined by segment end members on opposing sides of each lighting module and/or by the bottom portion or panel and/or top element 370. Furthermore, top element 370 can include an aperture, perforation, port or other access opening into inner cavity 380.

The passageway 380 can provide a pleasing aesthetic to the viewer. Additionally or alternatively, the passageway 380 can facilitate mounting of the lighting fixture 300 to a support surface. It should be appreciated that the passageway 380 can have various shapes and configurations, which can vary from one implementation to another. For example, in one implementation, the passageway 380 can have a substantially cylindrical or ring shape. Furthermore, passageway 380 can be configured to hide, house, or accommodate wiring, lighting, hardware, or any other appropriate additional elements.

Lighting fixture 300 can also include a lid or other covering member (not shown) configured to seal, close, or otherwise cover at least a portion of inner cavity 380 and/or opening in top element 370. In a preferred implementation, the coupling of various elements of lighting fixture 300 (including: bottom portion or panel (not shown); inner elements or shade(s) 330*a*, 330*b*; out element(s) or shade(s) 310*a*, 310*b*; top element 370; lid or covering member (not shown); and/or segment end member(s) such as, for example, segment end member(s) 309*a*, 309*b*) provides a fully enclosed lighting fixture, assembly, or structure. A fully enclosed lighting fixture, assembly, or structure can be configured such that dust, debris, refuse, insects, and other undesirable matter are excluded or otherwise prevented from entering inner cavity 380. A modular lighting fixture 300 can also comprise a plurality of inner cavities 380 defined by a plurality of intermittent segment end members such as, for example, segment end member 309*a* and 309*b*.

Figure 3B:
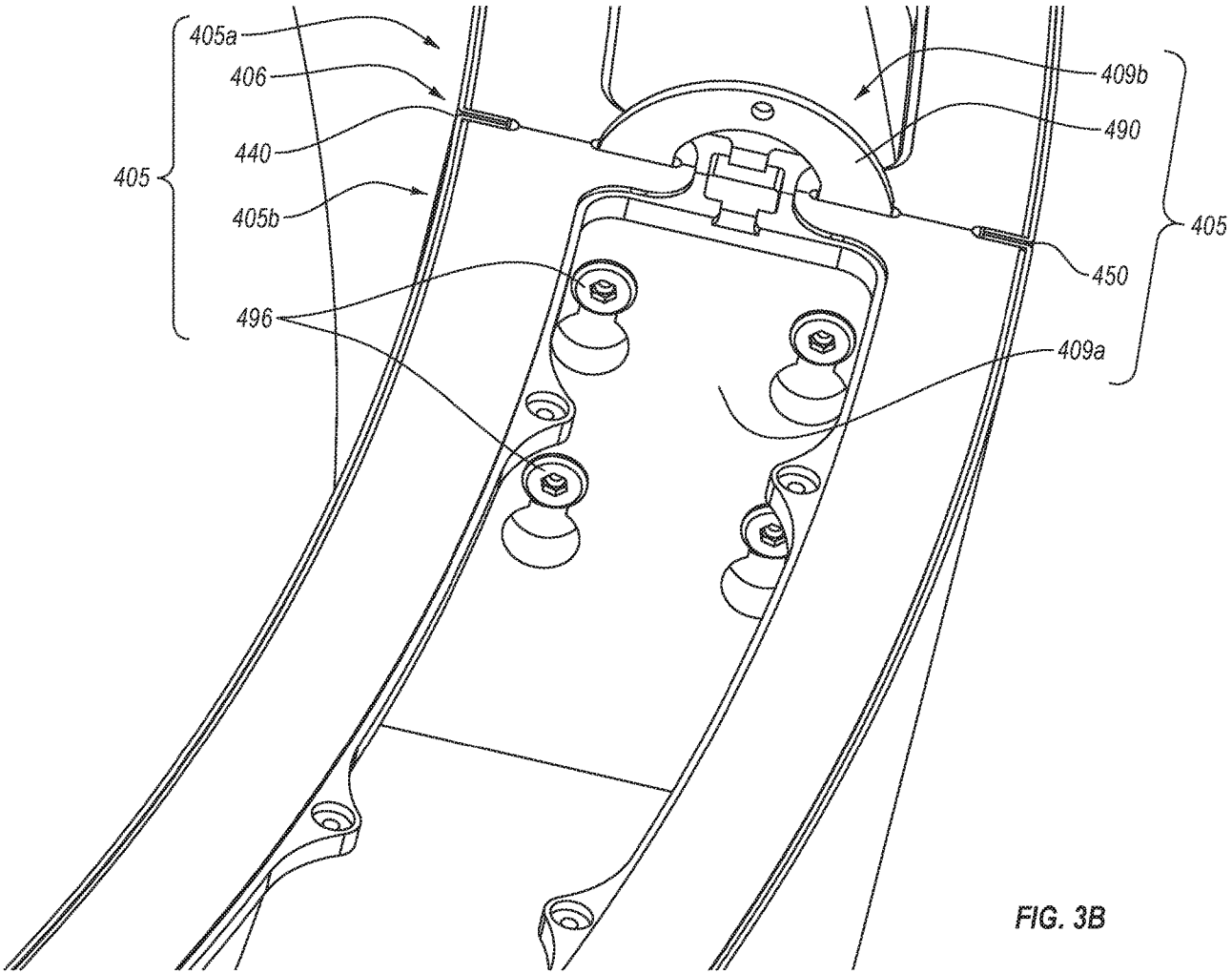
FIG. 3B illustrates a top perspective view of a coupling junction between two lighting modules in accordance with another implementation of the present disclosure.

FIG. 3B illustrates an implementation in which lighting modules 405 are coupled together at interface 406. In particular, lighting modules 405*a* and 405*b* can be joined and/or secured together by means of one or more removable fasteners 496. In at least one implementation, one or more fasteners 496 may pass through segment end member(s) 409*a*, 409*b* and through bracket 490 (positioned therebetween, illustratively). In a preferred implementation, a plurality of fasteners 496 can also secure lighting modules 405*a* and 405*b* together at or near the outer and inner regions of segment end members 409*a* and 409*b*. For instance, fasteners 496 can be positioned near, adjacent, or otherwise in proximity to (outer) seam 440 and/or (inner) seam 450. In certain implementations, fasteners 496 can be positioned near upper and/or lower areas or regions of segment end members 409*a* and 409*b*, in proximity to (outer) seam 440 and/or (inner) seam 450.

Figure 4A:
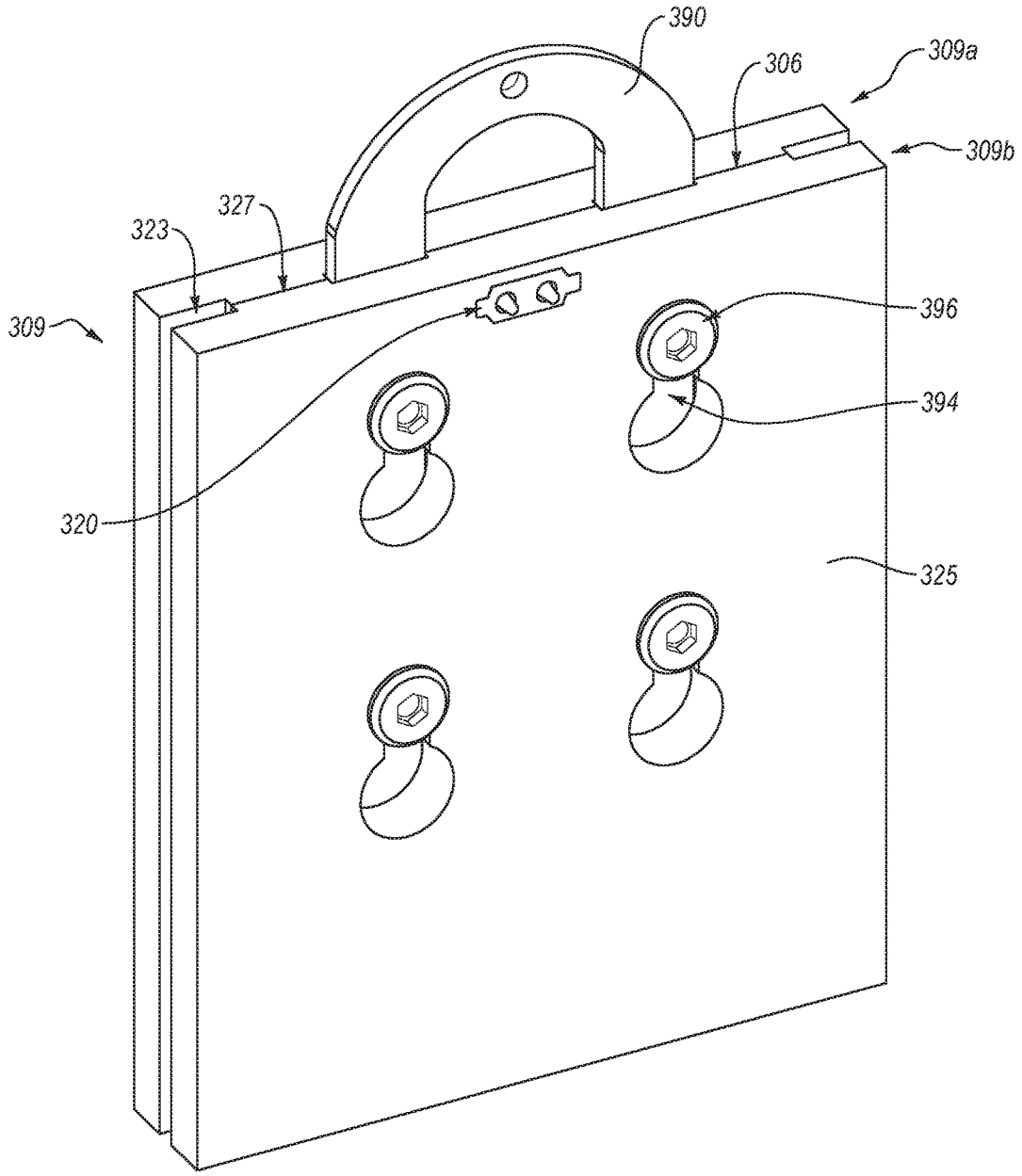
FIG. 4A illustrates a perspective view of a connective junction assembly in accordance with an implementation of the present disclosure.

FIG. 4A illustrates a perspective view of a connective junction assembly (or end piece assembly) 309 in accordance with an implementation of the present disclosure. As discussed above in connection with FIG. 3A, and piece assembly 309 can include a first end piece 309*a* and a second end piece 309*b*, which can be coupled together or joined at junction or interface 306. In at least one implementation, end pieces 309*a* and 309*b* can be joined in a flush configuration. For instance, end pieces 309*a* and 309*b* can each comprise an outer end face 325 and an opposing inner end face 327. For instance, as illustrated in FIG. 4A, the respective inner end faces 327 of end pieces 309*a* and 309*b* can be in direct contact in an assembled connective junction assembly 309. Those skilled in the art will appreciate that end pieces 309*a* and 309*b* can be in direct and/or flush contact while retaining one or more slots or gaps 323 therebetween. Accordingly, inner end faces 327 of end pieces 309*a* and 309*b* can have one or more recessed areas.

Connected junction assembly 309 can also have a mounting bracket 390. Mounting bracket 390 can be disposed between end pieces 309*a* and 309*b*. As will be discussed in further detail below, mounting bracket 390 can be positioned at least partially within one or more slots 323. In other words, at least a portion of mounting bracket 390 can be positioned within one or more slots 323. As discussed in further detail below, connective junction assembly 309 can also have an electrical connection element 320. Electrical connection element 320 can be connected to one or more of end pieces 309*a* and 309*b*. In at least one embodiment each of end pieces 309*a* and 309*b* can include an electrical connection element 320. Flush contact between end pieces 309*a* and 309*b* or inner end faces 327 thereof can result in direct and/or electrical contact between the respective electrical connection elements 320 of end pieces 309*a* and 309*b*.

Figure 4B:
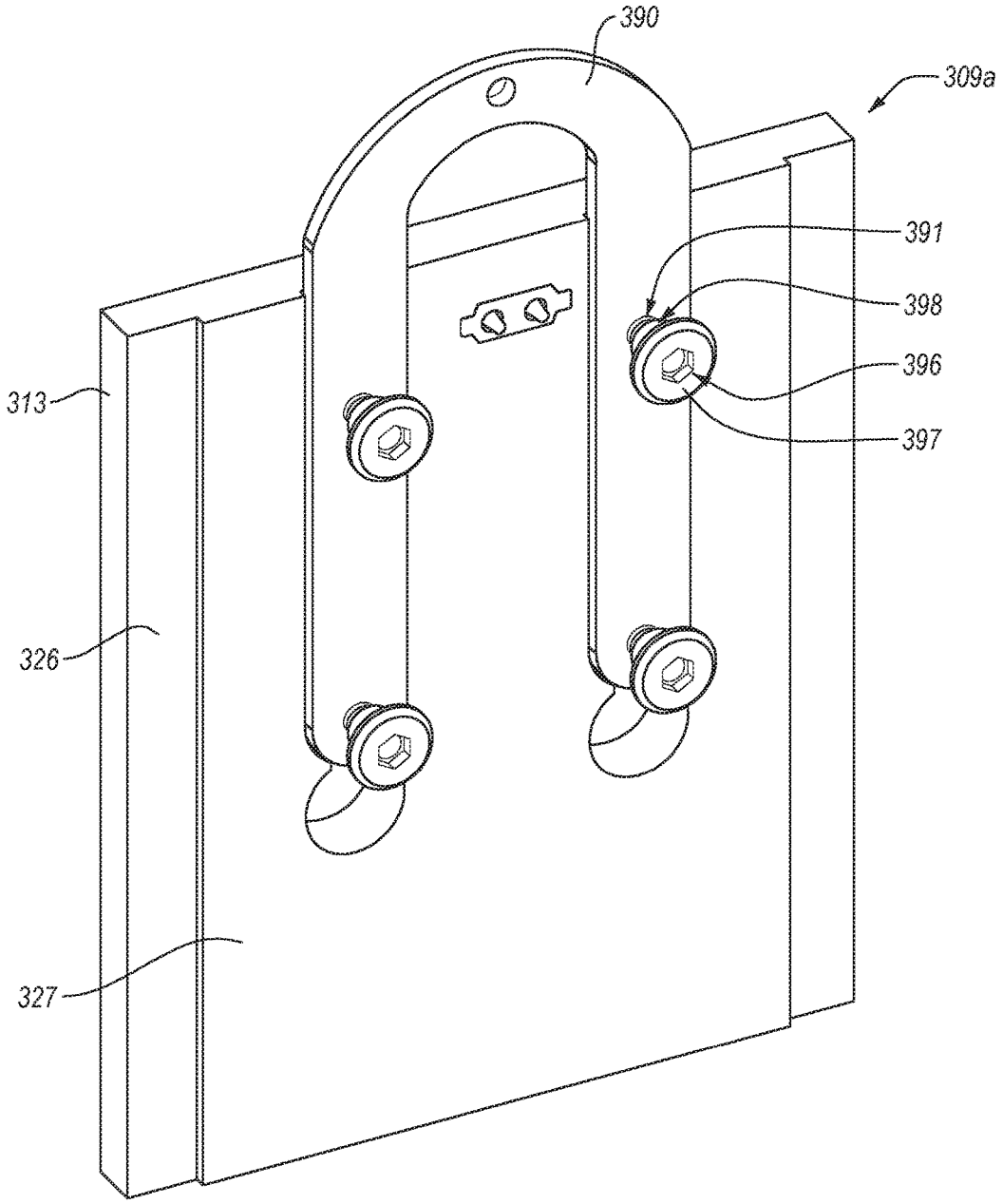
FIG. 4B illustrates a perspective view of an end piece assembly of the connective junction assembly of FIG. 4A.

Connective junction assembly 309 can be coupled, joined, and/or held together by one or more fasteners 396. As illustrated in FIG. 4A, fastener 396 can pass through opening 394 in connective junction assembly 309 or end pieces 309*a* and 309*b* thereof. As illustrated in FIG. 4B, end piece 309*a* and/or inner end face 327 thereof can have one or more recesses 326. Recess 326 can extend from side face 313 at least partially toward the center of inner end face 327. As will be discussed in further detail below, the depth of recess 326 can be about, approximately, and/or equal to the thickness of the outer element or shade of a lighting fixture (see e.g., outer element or shade 110 of lighting fixture 100).

FIG. 4B also illustrates the attachment of bracket 390 to the inner end face 327 of end piece 309*a* via fastener 396. Fastener 396 can include a large fastener portion 397 and a small fastener portion 398 in some implementations. For instance, small fastener portion 398 can include a threaded post or screw portion and large fastener portion 398 can comprise a nut or other attachment member. Fastener 396 can pass through bracket fastener opening 391 in bracket 390 and/or through opening 394 in end piece 309*a*. Those skilled in the art will appreciate that bracket-attached end piece 309*a* can be configured to receive second end piece 309*b*. For instance, opening 394 in end piece 309*b* can be slid over fastener 396 and/or large fastener portion 397 thereof. In other words, large fastener portion 397 can be passed through opening 394 in end piece 309*b*. End piece 309*b* can then be adjusted such that opening 394 rests on small fastener portion 398.

Figure 4C:
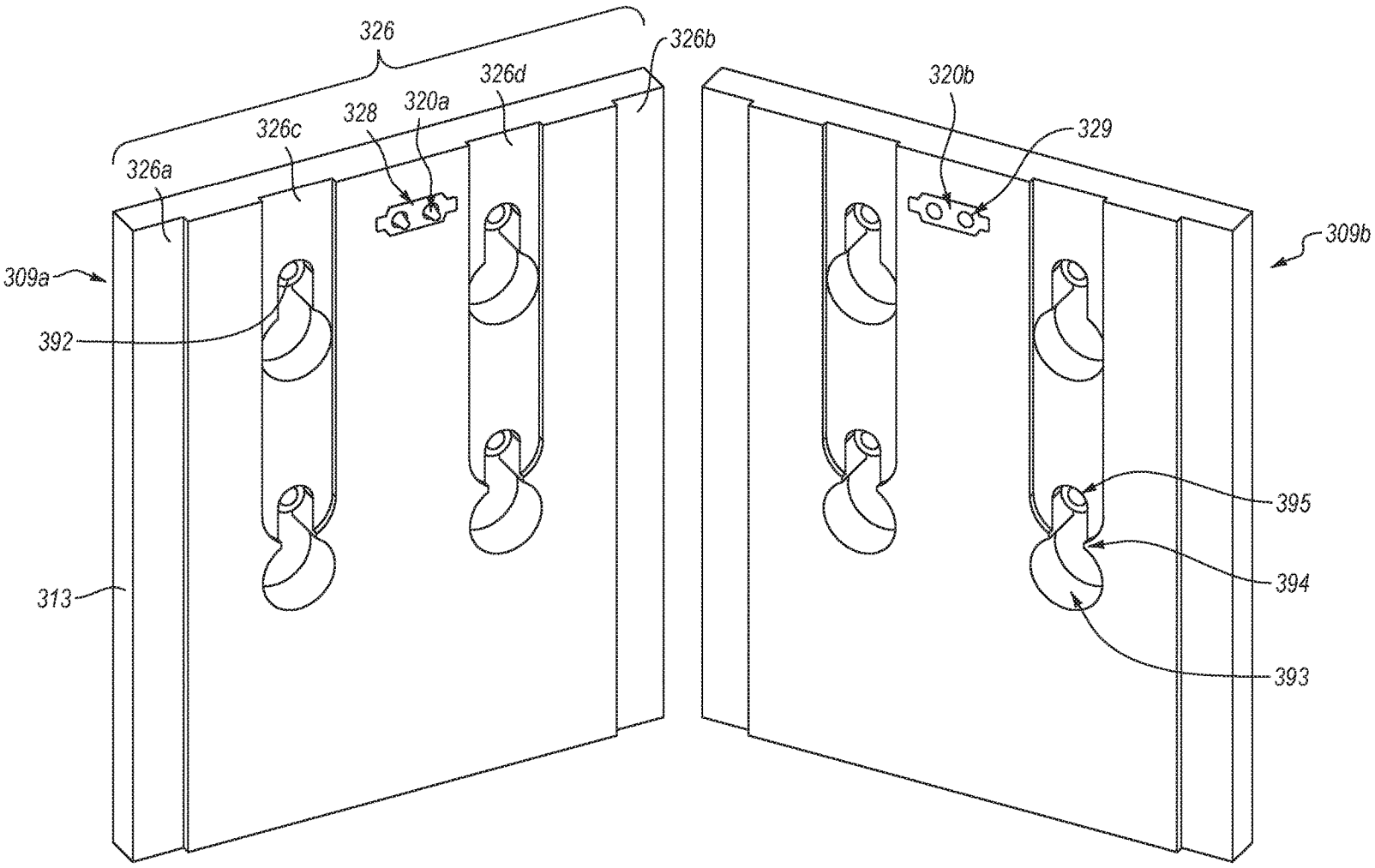
FIG. 4C illustrates a perspective view of opposing end pieces of the connective junction assembly of FIG. 4A.

For instance, as illustrated in FIG. 4C, opening 394 of end piece 309*b* can include a large opening portion 393 and a smaller opening portion 395. Thus, large fastener portion 397 of fastener 396 can be passed through large opening portion 393 of opening 394 in end piece 309*b*. End piece 309*b* can then be positioned (e.g., shifted and or slid down word) such that smaller opening portion 395 is disposed on small fastener portion 398. In other implementations, however, fastener 396 can secure end pieces 309*a* and 309*b* together through one or more different mechanisms. For instance, end pieces 309*a* and/or 309*b* can include one or more fastener receiving elements 392 (disposed with in opening 394). Fastener 396 can be secured through openings 394 and/or within fastener receiving element 392.

As illustrated in FIG. 4C, end piece 309*a* and/or 309*b* can include a plurality of recessed portions 326. For instance, end piece 309*a* can include a first recess 326*a* extending from side face 313 thereof. End piece 309*a* can also include a second recess 326*b* extending from an opposing side face. End piece 309*a* can also include a third recess 326*c* and/or a fourth recess 326*d* disposed away from side faces 313. Recess 326*c* and/or 326*d* can be configured to receive mounting bracket 390.

End pieces 309*a* and/or 309*b* can also include electrical connection elements 320*a* and 320*b*, respectively. Electrical connection element 320*a* can comprise a male end 328 in some implementations. Electrical connection element 320*b* can comprise a female end 329 in some implementations. Those skilled in the art will appreciate that electrical connection elements 320*a* and 320*b* can each comprise a male end 328 and a female end 329.

In some implementations, the compatibility of electrical connection elements 320 can provide simple or easy install mechanism and/or maintenance (e.g., cleaning and re-lamping) mechanism. For example, with a male/female spring connector embedded each of the end pieces 309*a* and/or 309*b*, the bulkhead end pieces of each modular section (e.g., connected component or ring section) can be adapted for instant electrical connectivity with an adjacent and/or connected module. Accordingly, when the parts are bolted, joined and/or connected together (e.g., on-site), the electrical connection between components is reliably made without an additional step (e.g., by an electrician stringing wires between modules). As discussed in further detail below, the electrical connection elements 320*a* and 320*b* (e.g., spring pins) in the bulkheads can be connected to additional sets of electrical connection elements in the upper or top assembly or component thereof (e.g., top portion or diffuser) to coordinate, power, and/or operate one or more lighting assemblies.

Figure 5A:
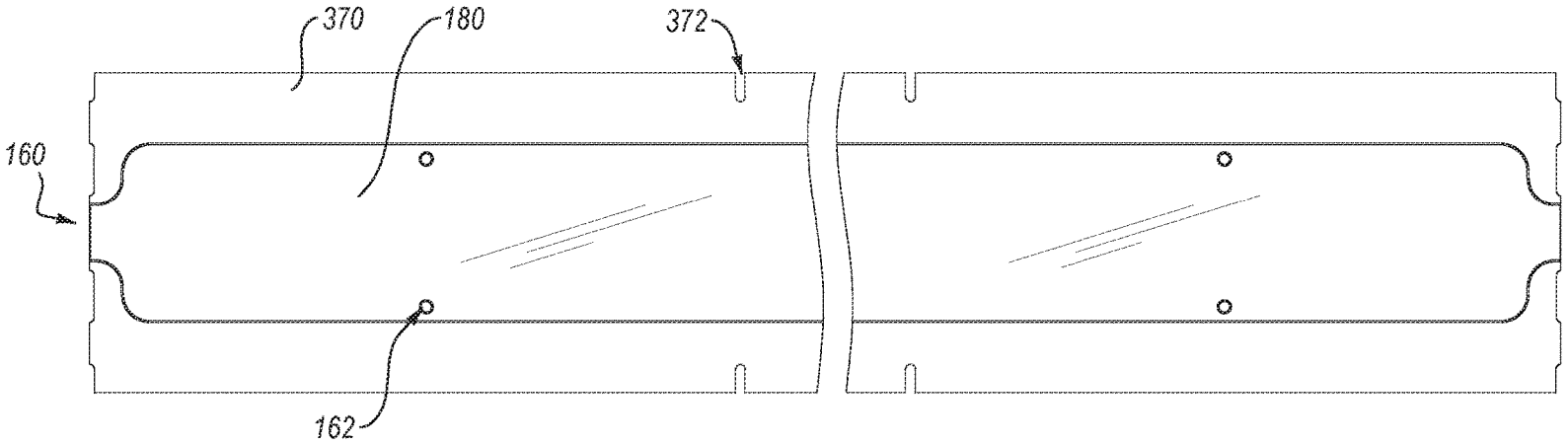
FIG. 5A illustrates a top plan view of an upper assembly in accordance with an implementation of the present disclosure.

FIG. 5A illustrates a top plan view of an upper assembly 160 in accordance with an implementation of the present disclosure. Upper assembly 160 can include top element 370 and/or cover (e.g., lighting assembly) 180. Upper assembly 160 can include an attachment mechanism 162 for connecting top element 370 and cover 180. Attachment mechanism 162 can include magnetic components, threaded components, clasping components, clipping components, or any other suitable attachment means or means for attachment. Upper assembly 160 can also include one or more notches 372. Notches 372 can be configured for receiving outer elements of the lighting fixture. For instance, a single upper assembly 160 can span one, two, three, more lighting modules. Thus, the flanged edges of the outer elements of two connected lighting modules can be inserted into notch 372 of upper assembly 160.

Figure 5B:
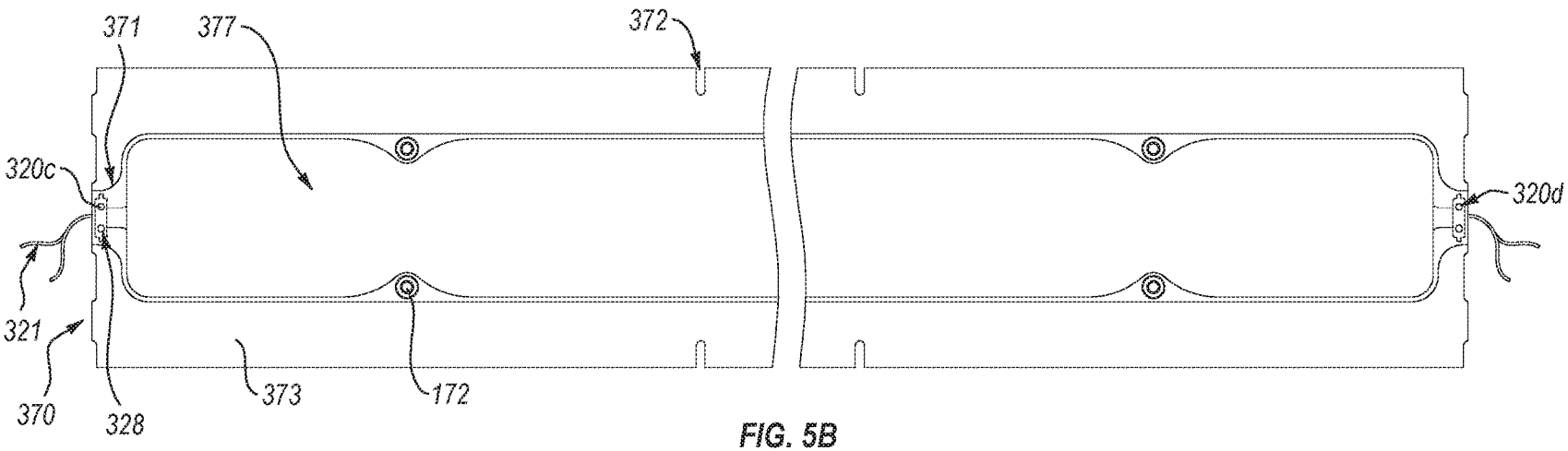
FIG. 5B illustrates a top plan view of a top element of the upper assembly of FIG. 5A.

FIG. 5B illustrates a top plan view of a top element or upper portion 370 of upper assembly 160. Top element 370 can include one or more longitudinal sides 373 and/or one or more support members 371. Top element 370 can also include an opening 377 (e.g., disposed between opposing longitudinal sides 373 and/or opposing support members 371). Top element 370 can also include one or more attachment elements 172. As illustrated in FIG. 5B, top element 370 can include one or more (e.g., opposing) electrical connection elements 320*c* and/or 320*d*. In at least one implementation, electrical connection elements 320*c* and/or 320*d* can comprise (male) spring pins or contact element 328. Electrical connection elements 320*c* and/or 320*d* can include one or more connectors 321. Connectors 321 can be configured to electrically connect electrical connection elements 320*c* and/or 320*d* to electrical connection element 320*a* and/or 320*b* of one or more and pieces 309*a*, 309*b*. Top element 370 can also include one or more notches 372 (e.g., in the outer edge of longitudinal sides 373).

Figure 5C:
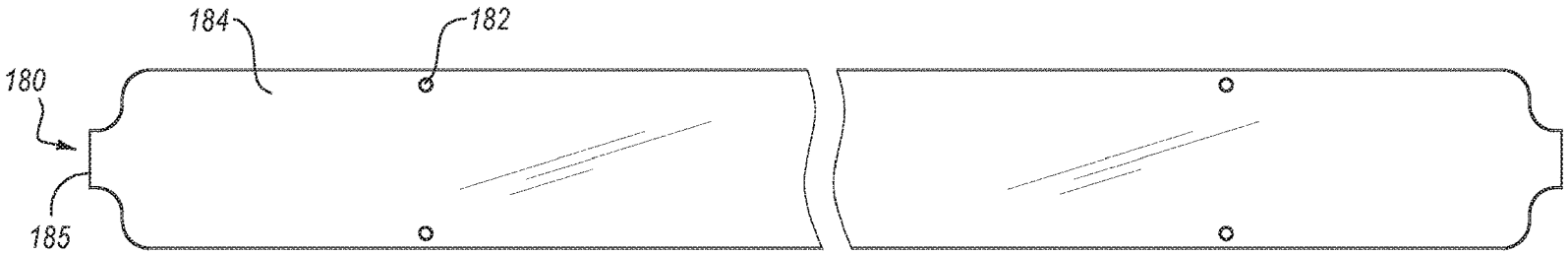
FIG. 5C illustrates a top plan view of a lighting assembly of the upper assembly of FIG. 5A.
Figure 5D:
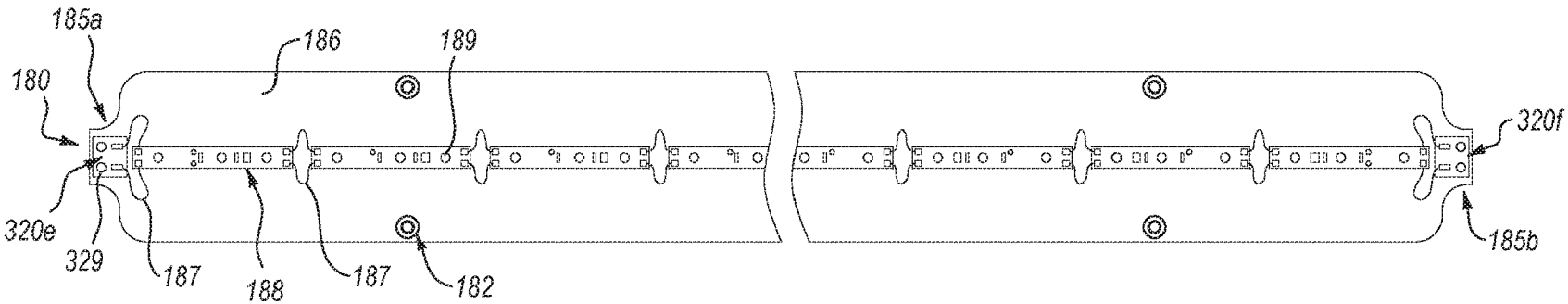
FIG. 5D illustrates a bottom plan view of the lighting assembly of FIG. 5C.

FIG. 5C illustrates a top plan view of cover 180 of upper assembly 160. Cover 180 can include a top or upper surface 184 and/or one or more attachment elements 182. Cover 180 can also include one or more (e.g., opposing) end portions 185. End portion(s) 185 of cover 180 can be configured to align and/or mate with support member(s) 371 of top element 370. As illustrated in FIG. 5D, cover 180 can comprise a lighting assembly in certain implementations. FIG. 5D illustrates a bottom plan view of the lighting assembly 180 according to at least one implementation of the present disclosure.

Lighting assembly 180 can include one or more lighting elements 188 (e.g., attached to bottom surface 186 of lighting assembly 180). Lighting element(s) 188 can comprise an LED circuit having one or more illuminating members 189, or any suitable means for illuminating known in the art. As illustrated in FIG. 5D, a plurality of lighting elements 188 can be connected via one or more connectors 187. The plurality of lighting elements 188 can also be connected via connector(s) 187 to one or more electrical connection elements 320*e* and/or 320*f*. In at least one implementation, electrical connection element 320*e* attached to end portion 185*a*, can be electrically coupled to the plurality of lighting elements 188 via one or more connectors 187. The plurality of connected lighting elements can similarly be connected to electrical connection element 320*f* attached to end portion 185*b* via one or more connectors 187.

In some implementations, electrical connection elements 320*e* and/or 320*f* can comprise a custom-designed PCB configured to align and/or mate with electrical connection elements 320*c* and/or 320*d* of top element 370. For instance, electrical connection elements 320*e* and/or 320*f* can comprise a (female) contact element 329. Contact element 329 can be adapted to align and/or mate with the (male) spring pins or contact element 328 of electrical connection elements 320*c* and/or 320*d*.

Accordingly, those skilled in the art will appreciate that an assembled lighting module (such as a lighting module 105 of FIG. 1B) can comprise a connection-ready unit of a lighting system or lighting system kit configured for assembly into one or more lighting fixtures or lighting fixture assemblies. For instance, the lighting module can comprise a bottom element or bottom portion. The bottom element can have a first end and an outer side edge extending from the first end. The bottom element can also have an inner side edge (e.g., opposite the outer side edge and/or extending from the first end) and/or one or more additional ends. For instance, the bottom element can have a second end (e.g., opposite the first end). Thus, the bottom element can have (opposing) first and second ends. In some implementations, (opposing) first and second ends can be arranged in a linear, curved, angled, or other relationship or orientation. In an implementation comprising (only) a first end and an opposing second end, the outer side edge and/or inner side edge can extend from the first end to the second end. In an alternative implementation, the bottom element can have more than two ends. For instance, the bottom element can have three, four, five, or more ends.

The lighting module can also comprise a first end piece connected to and/or extending (upward) from the bottom element. The first end piece can have an outer end face aligned with the first end of the bottom portion (or a first end face thereof), an outer side face aligned with the outer side edge of the bottom portion (or outer side edge face thereof), and/or an inner side face aligned with the inner side edge of the bottom portion (or inner side edge face thereof).

In some implementations, the lighting module can comprise a second end piece connected to and/or extending (upward) from the bottom element. For instance, the first end piece can have an outer end face aligned with a second end of the bottom portion (or a second end face thereof), an outer side face aligned with the outer side edge of the bottom portion (or outer side edge face thereof), and/or an inner side face aligned with the inner side edge of the bottom portion (or inner side edge face thereof).

The lighting module can also comprise an outer side element (or shade) coupled to the outer side edge of the bottom portion and/or the outer side face of the first end piece. The outer side element can extend from the first end of the bottom portion (e.g., towards a second end thereof). In some implementations, the outer side element (or shade) can be coupled to the outer side edge of the bottom portion and/or the outer side face of the second end piece at the second end.

In some implementations, the lighting module can also comprise an inner side element coupled to the inner side edge of the bottom portion and the inner side face of the first end piece. The inner side element can also extend from the first end of the bottom portion (e.g., to or towards the second or other end thereof). In at least one implementation the inner side element can extend from the first end of the bottom portion to or towards a different end of the bottom portion than the end to which the outer side element extends. In such an implementation, the bottom portion comprises three or more ends. In an implementation comprising (only) a first end and an opposing second end, however, inner side element and outer side element can extend from the first end of the body portion to or towards the same second end of the body portion.

In some implementations, the lighting module can also comprise an upper assembly (opposite the bottom element). The upper assembly and/or one or more components thereof can have a first end (corresponding to the first end of the bottom element), an outer side edge extending from the first end, an inner side edge opposite the outer side edge and extending from the first end, and/or one or more additional (i.e., second, third, fourth, fifth, etc.) ends. In some implementations, the upper assembly and/or one or more components thereof can be configured similar to and/or paid substantially identical to the bottom element. The upper assembly and/or one or more components thereof can also be coupled to one or more of the first end piece, optional second end piece, outer element or shaped, and optional inner element or shade. Thus, in some implementations, the module can comprise an enclosed or substantially enclosed (e.g., six-or-more-sided), three-dimensional modular unit.

As discussed above in relation to FIGS. 4A through 4C, first and/or second end pieces can comprise electrical connection element(s). In an implementation comprising (only) a first end and an opposing second end, for instance, first and second opposing end pieces connected to opposing first and second ends of the bottom element, can each comprise an electrical connection element. The electrical connection elements of the first and/or second end pieces can be electrically coupled via one or more connectors to respective electrical connection elements connected to the upper assembly or component (e.g., top element) thereof. The electrical connection elements of the upper assembly or component (e.g., top element) thereof can be disposed on and work connected to opposing end of the upper assembly.

The opposing electrical connection elements of the upper assembly or component (e.g., top element) thereof can be aligned with and/or connected to the first and/or second electrical connection elements of the lighting assembly or cover. The first and second electrical connection elements of the lighting assembly can be connected to and/or disposed on first and second (opposing) end portions of the lighting assembly. The lighting elements of the lighting assembly can be connected in series and/or extend from the first end of the lighting assembly to the second end thereof (e.g., between the first and second electrical connection elements of the lighting assembly or cover. The series of lighting elements can be connected to the first and second electrical connection elements disposed at the first and second ends of the lighting assembly (e.g., forming an electrically coupled series extending from the first end piece, to the first end of the top element of the upper assembly, to the first end of the lighting assembly, through the series of lighting elements, to the second end of the lighting assembly, to the second end of the top element of the upper assembly, and to the second end piece.

A plurality of assembled lighting modules can then be connected together via respective end pieces to extend the series or electrical connectivity from one module to the next by means of the electrical connection elements disposed on the outer end face of the end pieces. A source of electricity, electrical energy, electrical current, and/or other form of power can be connected to the plurality of connected lighting modules to activate and/or operate the illuminating members of the lighting elements attached to the lighting assembly. In one or more implementations, the connected seam between two or more modules of the assembled lighting fixture can be de-emphasized by operating the illuminating members and/or otherwise illuminating the lighting fixture. For instance, one or more illuminating members can be positioned adjacent to and/or in proximity to the seam, thereby reducing the visibility of the seam when the one or more illuminating members are activated.

One or more hardware elements disposed between the connected lighting modules can also be deemphasized by a similar mechanism. For instance, the visibility of a suspension bracket disposed between end pieces of connected lighting modules and/or positioned in respective recessed portions thereof can be reduced in an illuminated lighting fixture relative to a lighting fixture in an unilluminated state, from at least one vantage point. For instance, the at least one vantage point can comprise viewing the bracket the roots of bottom element, inner element, outer element, end piece, and/or upper element.

Figure 6A:
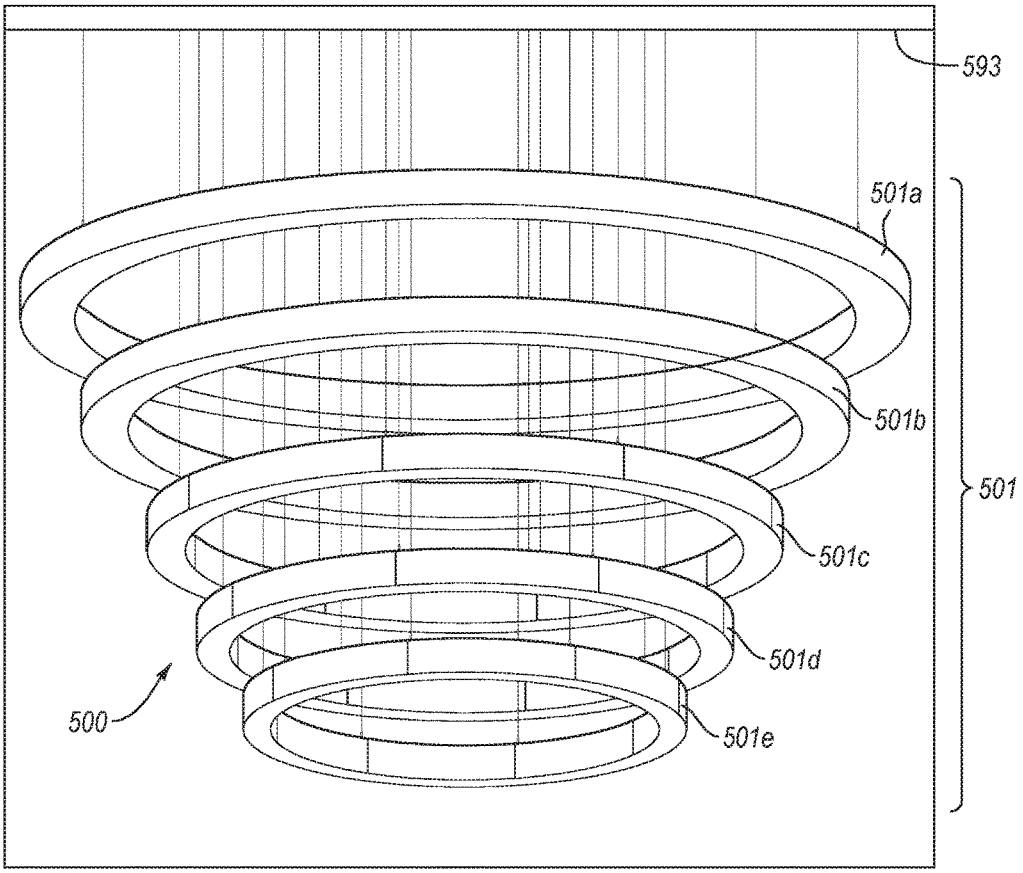
FIG. 6A illustrates a bottom perspective view of an arrangement of lighting fixtures in accordance with an implementation of the present disclosure.
Figure 6B:
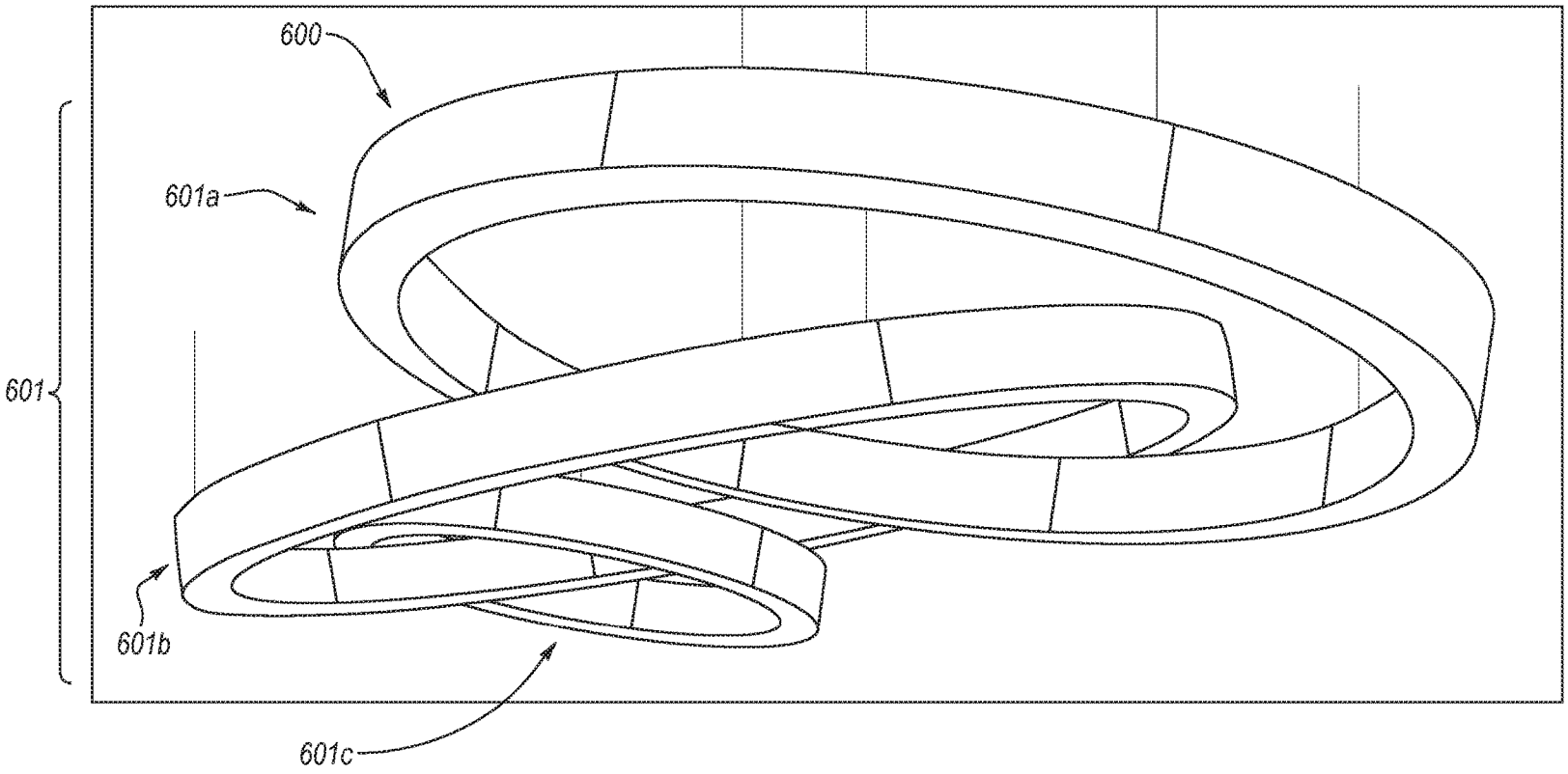
FIG. 6B illustrates a bottom perspective view of an arrangement of lighting fixtures in accordance with another implementation of the present disclosure.

FIGS. 6A and 6B illustrate various lighting fixture assemblies (or arrangements thereof) according to implementations of the present disclosure. For instance, FIG. 6A illustrates a lighting assembly or arrangement 500 of five (5) lighting fixtures 501 (e.g., 501*a*, 501*b*, 501*c*, 501*d*, 501*e*), each of a different size. One will appreciate, however, that similar and/or identically sized fixtures are also contemplated herein. Specifically, each lighting fixture 501 comprises a ring-shaped structure having a defined radius. In particular, each lighting fixture 501 has a unique radius such that the arrangement 500 of lighting fixtures 501 are positioned or configured in ordered of descending or decreasing radius, forming an elaborate arrangement of vertically offset, concentric circles or ring-shaped lighting fixtures.

Furthermore, each lighting fixture 501 can comprise uniquely sized panels, portions, or components, such as, for example, side panels, outer and/or inner-element(s) or shade(s), bottom panel(s), and/or top panel(s), etc. Each ring-shaped lighting fixture 500 can be independently secured to a ceiling or other support surface or structure, including structural support member 593. Alternatively, the lighting assembly or arrangement can be so secured.

Figure 7:
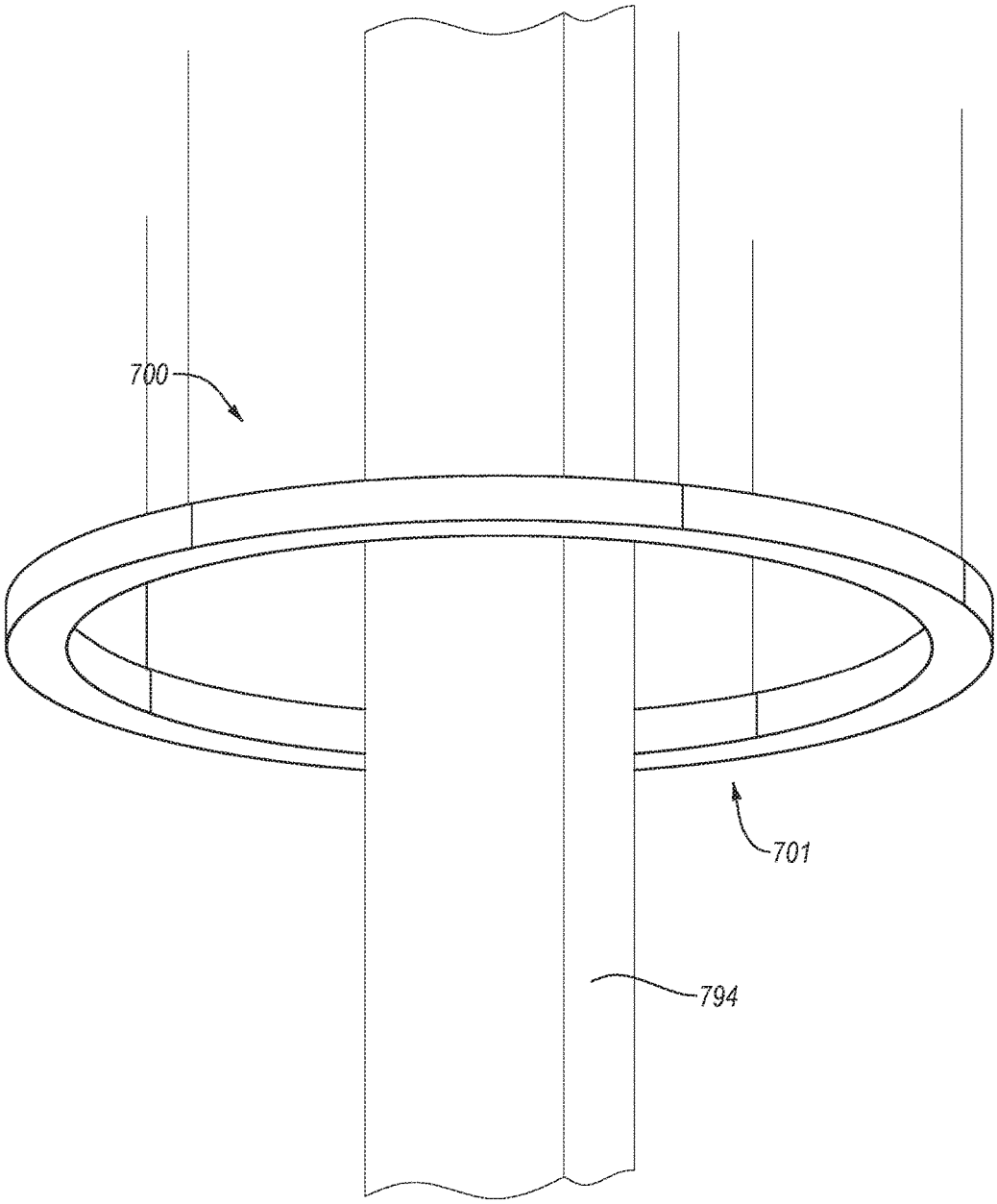
FIG. 7 illustrates a bottom perspective view of a lighting fixture assembly in accordance with another implementation of the present disclosure.
Figures 8A, 8B, 8C, 8D:
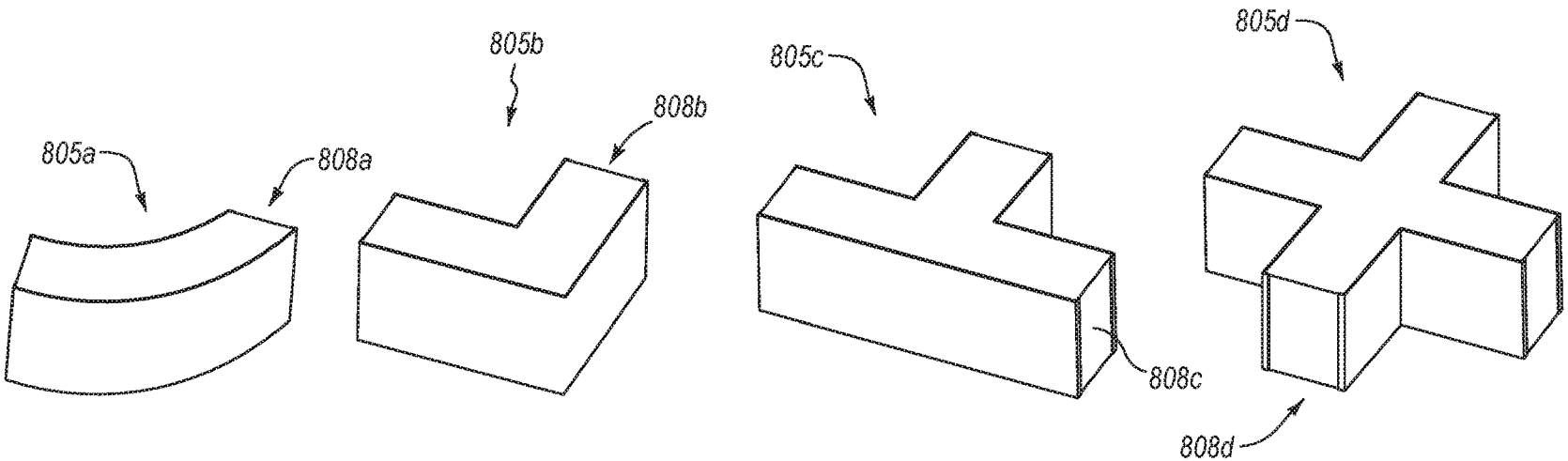
FIGS. 8A-8I illustrate bottom perspective views of lighting modules in accordance with implementations of the present disclosure.
Figures 8E, 8F, 8G, 8H:
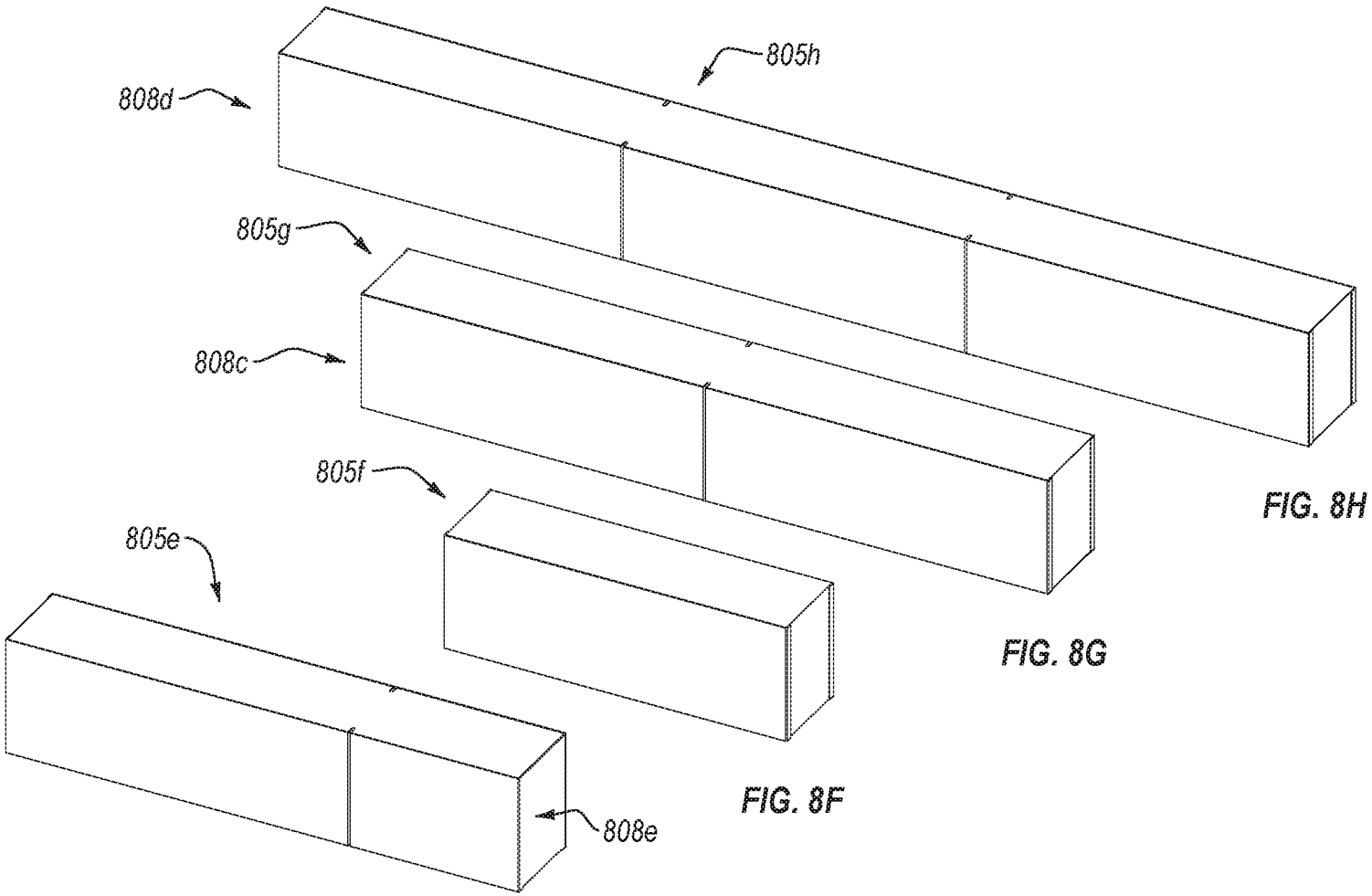
Figure 8I:
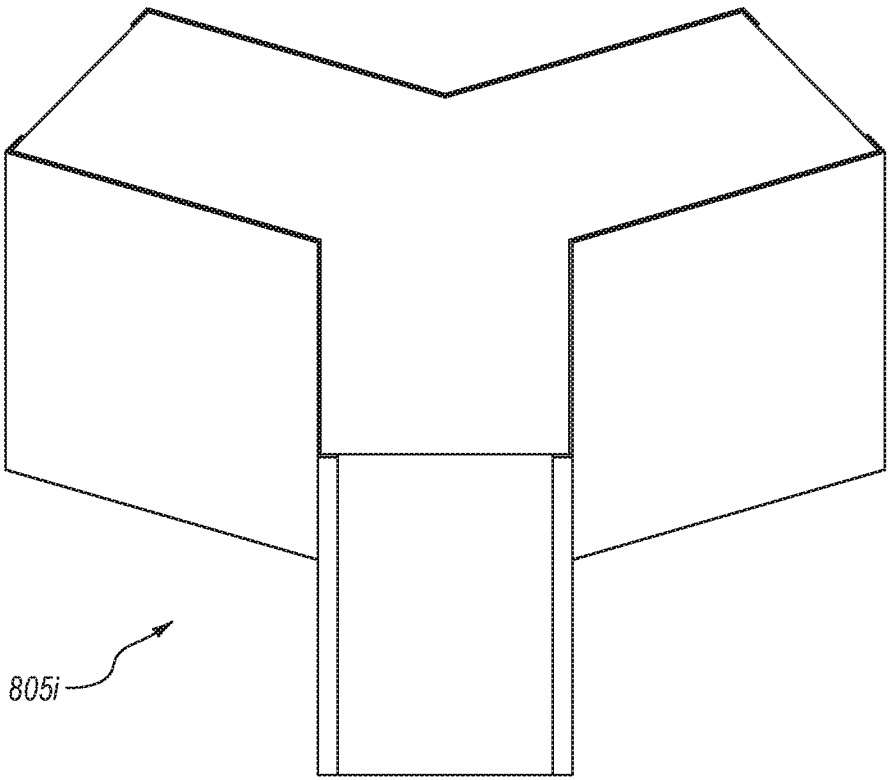

FIG. 6B illustrates an arrangement 600 of three (3) lighting fixtures 601 (e.g., 601*a*, 601*b*, 601*c*), each of a different size. One will appreciate, however, that similar and/or identically sized fixtures are also contemplated herein. Specifically, the lighting assembly or arrangement 600 includes inter-locking ring-shaped lighting fixtures 601. Other arrangements of lighting fixtures of various shapes and sizes are also contemplated herein, including ovals, rectangles, and/or winding, bending, curving, turning, or other arrangements. For instance, FIG. 7 illustrates an assembly 700 of lighting fixture 701. Specifically, lighting fixture 701 is configured as a ring-shaped structure positioned around a support structure or pillar 794.

FIGS. 8A-8I illustrate various illustrative shapes, sizes, and/or configurations of lighting modules 805*a*, 805*b*, 805*c*, 805*d*, 805*e*, 805*f*, 805*g*, 805*h*, 805*i* according to implementations of the present disclosure. Each lighting module illustrated therein can be compatible with one or more other modules illustrated therein. Such compatibility may allow for the construction, assembly, and/or installation of very simple, as well as very elaborate lighting fixtures, assemblies, and/or arrangements, or shapes. Thus, one or more implementations of the present disclosure includes a system for a modular lighting fixture with reduced or eliminated visibility of connective seams and/or hardware at the coupling interface between lighting modules, illustrative examples of which are presented below.

Example 1

Lighting modules 805*e*, 805*f*, 805*g*, and/or 805*h* can be inter-compatible such that the coupling of various segment ends allows for the formation of short, as well as long, linear, modular lighting fixtures. For example, lighting fixture 900, illustrated in FIG. 9, can comprise a plurality of linear lighting modules 805*e*, 805*f*, 805*g*, and/or 805*h* illustrated in FIGS. 8E-8H. Specifically, lighting fixture 900 can comprise a first module 805*e* and a second module 805*e*, each of which comprise a terminal segment end 808*e*. Those skilled in the art will appreciate that terminal segment and 808*e* need not include an end piece (e.g., end piece 309*a*) in some implementations. A first module 805*e* and second module 805*e* can comprise terminal ends of lighting fixture 900. Lighting fixture 900 can also comprise one or more of lighting modules 805*f*, 805*g*, and/or 805*h* coupled to (and between) first terminal module 805*e* and second terminal module 805*e*, such that a linear lighting fixture comprising two terminal ends is formed.

Example 2

Figure 10:
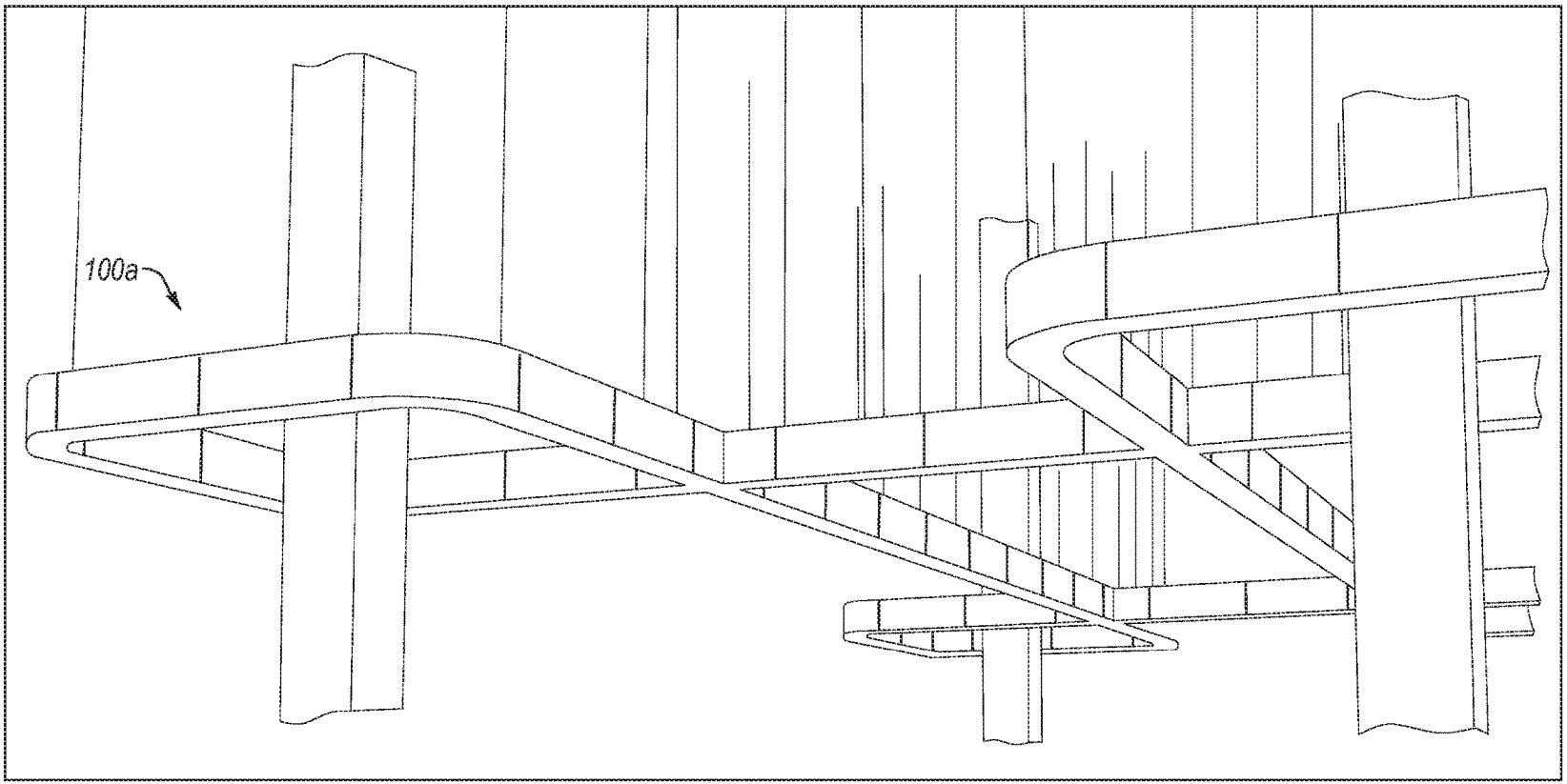
FIG. 10 illustrates a bottom perspective view of a lighting fixture assembly in accordance with an implementation of the present disclosure.
Figure 11:
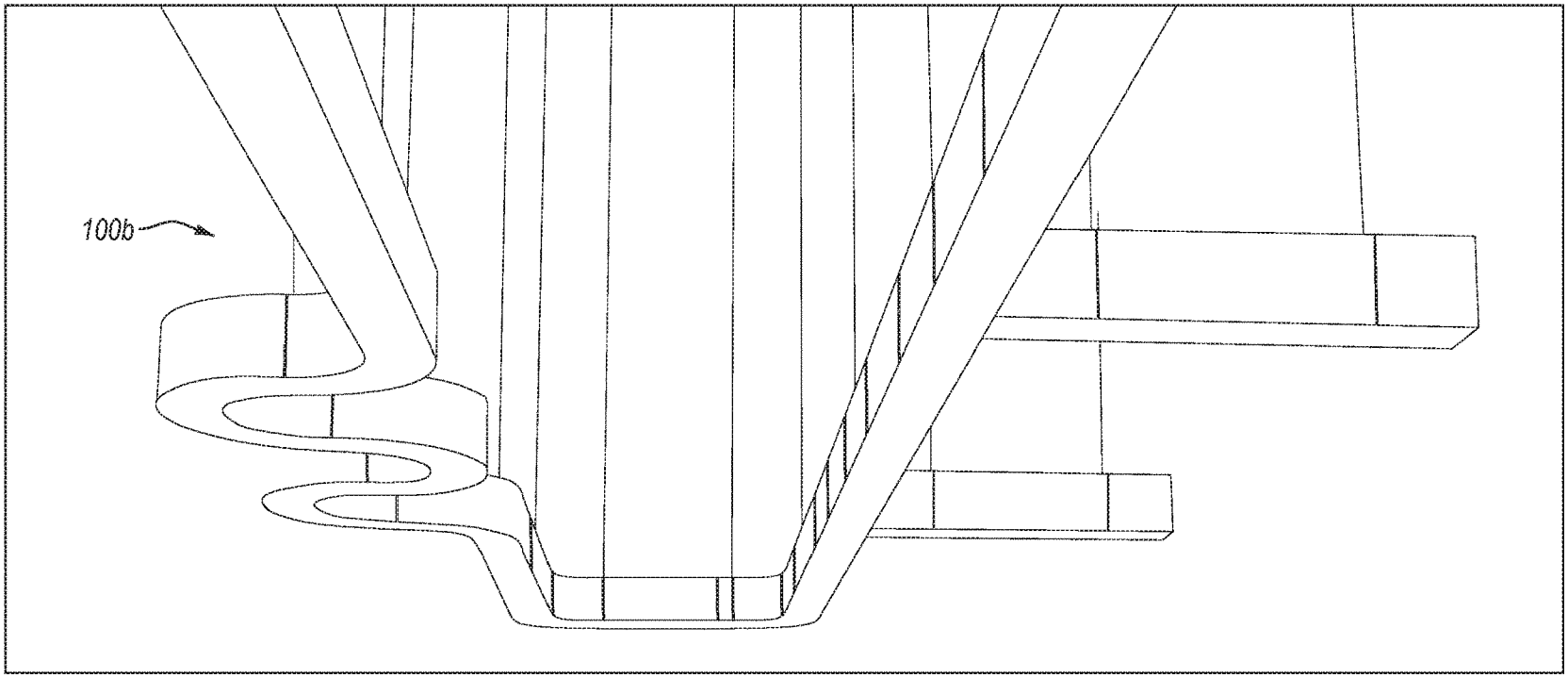
FIG. 11 illustrates a bottom perspective view of a lighting fixtures assembly in accordance with an another implementation of the present disclosure.

Lighting module 805*a* can be compatible with module 805*g* such that the coupling of a first segment end 808*a* of module 805*a*, to a first segment end 808*c* of module 805*g*, may form a multi-modular lighting unit comprising a straight portion with a 90 degree curved or rounded portion. Such a multi-modular lighting unit can be incorporated or otherwise used in the formation of an elaborate lighting fixture, assembly, and/or arrangement, such as, for instance, lighting fixture 100*a* illustrated in FIG. 10.

Example 3

Module 805*d* can be compatible with module 805*h* such that the coupling of a first segment end 808*b* of module 805*a*, to a first segment end 808*d* of module 805*h*, may form a multi-modular lighting unit comprising a straight portion with a 4-way intersecting or cross portion. Such a multi-modular lighting unit may likewise be incorporated or otherwise used in the formation of an elaborate lighting fixture, assembly, and/or arrangement, such as, for instance, lighting fixture 100*a* illustrated in FIG. 10. 3-way intersecting or forked portions, such as those illustrated in module 805*i* can also be compatible with modular arrangements described herein. Accordingly, modules of the present disclosure can comprise a plurality of segment ends, including 2, 3, 4, 5, etc.

Example 4

Lighting modules 805*a*, 805*c*, and 805*e* can be incorporated into a lighting fixture, such as fixture 100*b*, so as to form at least one closed-loop portion and at least one terminal end. Specifically, T-junction module 805*c* can be included in certain implementations to allow for such a configuration.

Accordingly, FIGS. 1A through 11, and the corresponding text, provide a number of different components and mechanisms for manufacturing a lighting fixture or assembly. In addition to the foregoing, implementations of the present disclosure also can be described in terms of one or more acts, events, or other steps in a method for accomplishing a particular result. For example, FIG. 12 illustrates a flowchart of one exemplary method for manufacturing a lighting fixture according to some implementations of the present disclosure.

Figure 12:
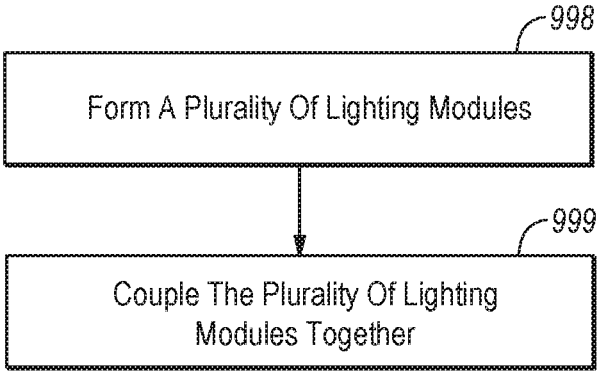
FIG. 12 illustrates a flowchart of an exemplary method of forming a lighting fixture in accordance with an implementation of the present disclosure.

According to FIG. 12, a method of manufacturing a modular lighting fixture can include an act 998 of forming lighting modules, such as the lighting modules 8A-8H (as well as the other modules described herein, and their equivalents). More specifically, the manufacturer can wrap the ends of side panels around ends, corners, sides, and/or angles of the respective bottom panels and/or segment end members (and/or into recesses or rabbited depressions thereof). As noted above, the bottom panel(s) can at least in part define the shape of the outer element or shade and, therefore, the shape of the module.

Furthermore, the manufacturer may couple, attach, fasten, secure, adhere, weld (e.g., with a welding solvent, ultrasonic welder, etc.), glue, or otherwise join the components together with an adhesive, solvent, fastener, and/or other mechanism of attachment. In some implementations, one or more fasteners can be used to secure or hold such components in place (e.g. while the illustrative adhesive or solvent is acting on said component(s)). In certain implementations, after joining the component(s), panel(s), or flange(s) thereof together, the manufacturer can optionally remove one or more fasteners from the component(s), panel(s), or flange(s) of the side panels and/or other components.

The method also can include an act 999 of coupling the modules together to form a lighting fixture, assembly, or structure thereof. For example, the manufacturer can couple, attach, fasten, secure, adhere, weld (e.g., with a welding solvent, ultrasonic welder, etc.), glue, or otherwise join the segment ends of the modules to form simple or complex designs (such as those illustrated in FIGS. 1A-1C, 6A-7, and 9-11). Certain implementations can include a module that has a terminal end or segment end (cap). Such a module can be positioned at a terminal end of the lighting fixture or assembly thereof.

Likewise, the method can include coupling the top panel(s) to the outer element(s) or shade(s) and/or inner element(s) or shade(s). Specifically, the flange(s) of side panels can be positioned within at least one notch, tick, nick, or crevice of the top panel(s). Furthermore, the method can include installing one or more lighting elements in the lighting fixture and/or securing a lid or other covering member over an opening in the top panel. In one or more implementations, the method includes securing one or more mounting elements or brackets to the lighting fixture (e.g., between segment ends or to the top panel).

In some implementations, a method of reducing and/or eliminating the visibility of support, connecting, and/or mounting hardware components of a lighting fixture is provided. For example, at the junction site between lighting modules of a modular lighting assembly, or between first and second ends of a wrap-around fixture, support hardware can be positioned such that visibility of the hardware is reduced when the lighting fixture is illuminated. Specifically, the hardware can be positioned within corresponding recesses in the respective coupling ends of the connected lighting modules or wrap-around fixture. In at least one implementation, the outer element can be folded over or wrapped around the respective outer edges of the coupling ends and partially into the junction site adjacent to the support hardware. Connective seams between the wrapped outer edges and support hardware at the junction between coupling ends of lighting modules or the wrap-around fixture can thus be de-emphasized when adjacent lighting elements are activated.

Thus, one or more implementations of the present disclosure include a method of reducing or eliminating the visibility of one or more connective seams and/or hardware at the coupling interface between ends of lighting components. Certain implementations include providing one or more lighting components including a plurality of coupling ends, folding and/or wrapping an outer element around the respective outer edges of the coupling ends, and joining and/or coupling first and second coupling ends such that a seam is formed at the junction between the first and second coupling ends. In at least one implementation, the visibility of the coupling seam is reduced and/or eliminated when the one or more lighting components or lighting elements adjacent to the junction site is illuminated.

Example 5

As mentioned above in reference to FIG. 1B, the lighting fixture 100 can have a modular configuration, which, for instance, can allow the manufacturer to assemble the lighting fixture 100 in just-in-time manner. More specifically, the outer element or shade 110 can comprise one or more side panels 111, such as side panels 111*a*, 160, coupled together. Similarly, the inner element or shade 130 can comprise one or more side panels 111, such as side panels 111*c* and 111*d*, which can couple together to form the inner element or shade 130. The side panels 111 can comprise a thermoplastic material in one or more implementations. Alternatively, the side panels 111 also (or alternatively) can comprise sheet metal, such as aluminum, steel, copper, and other similar metals and materials.

More specifically, the side panels 111 can comprise thin sheets of a thermoplastic material (e.g., PETG, PMMA, and PC). For example, in one implementation the side panels 111 comprise 1/16" PETG sheets. The thin gauge of the side panels 111 can allow light to pass therethrough, can allow for cold or other forming, and can reduce the weight of the lighting fixture 100. In alternative implementations, the side panels 111 can have a thickness greater than about 1/16", such as about 1/8" or 1/4". In still further implementations, the side panels 111 can have a thickness less than about 1/16", such as about 1/32".

Additionally, the side panels 111 can be translucent and can at least partially diffuse the light emitted by or from the lighting fixture 100 (or lighting elements thereof; not shown). In at least one implementation, the side panels 111 can have different translucency, shading, and/or color than the bottom panel 120 and/or the top panel (see e.g., top panel 370 illustrated in FIGS. 1C and 3A). Accordingly, for example, the lighting fixture 100 may transmit more light through the bottom panel 120 than through the side panels 111. Conversely, the lighting fixture 100 can transmit more light through the side panels 111 than through the bottom panel 120. Thus, the assembler or designer can choose a particular direction for the light exiting the lighting fixture 100.

In addition to the foregoing, the inner surface of the side panels 111 can optionally include a diffusion layer. The diffuser layer (or diffusion surface finish) can further assist in evenly distributing the light uniformly across the side panels 111 and throughout the interior space (see e.g., channel or passageway 380 illustrated in FIG. 3A) of the lighting fixture 100. For example, the side panels 111 can include a thin white translucent layer on the inner surface. A manufacturer/designer can use the white translucent layer (also known as a "Ghost" layer) to increase the reflective properties of the inner surface of the side panels 111, while at the same time allowing light to pass through the side panels 111. The white translucent layer can be added to any material, portion, or "panel" section discussed herein, and can have a thickness of about one millimeter (1 mm).

In addition to the light diffusion characteristics discussed above, the light fixture 100 can include one or more light sources that a manufacturer/designer can configure and position to provide a light source that allows for uniform distribution of light across all panels and throughout the lighting fixture. A manufacturer/designer can choose the type, location, and configuration of the light source depending on the size and configuration of the lighting fixture. For example, the type of light source can vary from one implementation to the next, as well as within the same implementation. Example types of light sources can include, but are not limited to, fluorescent light bulbs, incandescent light bulbs, and LEDs. LEDs in particular can vary from one implementation to the next, depending on the overall size and configuration of the lighting fixture. For example, LEDs used in connection with implementations of the present disclosure can include LED strips, tape, boards, or other LED configurations.

Also, as described above, the side panels 111 can couple together to form a three-dimensional shape such as the outer element or shade 110 and/or the inner element 130. In light of this disclosure, those skilled in the art should appreciate that any two or more of the side panels 111 can have the same or similar size (e.g., width, height, and/or thickness). Accordingly, the side panels 111 that form the outer element or shade 110 can have the same size as the side panels 111 that form the inner element or shade 130. Thus, the manufacturer can simplify storage and/or production of the side panels 111, which may lead to reduction in manufacturing costs of the lighting fixture 100.

In at least one implementation, the manufacturer can cold form (i.e., elastically deform) the side panels 111 into a desired shape. For instance, the side panels 160 can be sufficiently rigid and/or flexible to allow such bending. Particularly, the manufacturer can bend the side panels 111 into a substantially cylindrical shape, such as the outer element or shade 110 and/or the inner element or shade 130.

Moreover, as described above, the manufacturer can elastically bend the side panels 111 into desired shapes, after coupling the side panels 111 together, to form inner and/or outer elements. Such inner and/or outer elements can be sufficiently flexible to allow further elastic and/or plastic deformation and conforming to the corresponding profiles of the top and/or bottom panels. In other words, the manufacturer can further bend the side panels 111 after assembling the side panels 111 together into inner or outer elements.

Alternatively, however, the manufacturer can plastically deform the side panels 111 before, during, and/or after coupling the side panels 111 together to form the inner or outer elements. For example, the manufacturer can pre-bend the side panels 111, by (plastically) deforming the side panels 111 into desired shapes. The manufacturer also can heat and bend the side panels 111 into desired shapes and subsequently cool the side panels 111. After bending the side panels 111 into the desired shapes, the manufacturer can assemble the inner and/or outer elements by coupling the side panels 111 together.

As noted above, the bottom panel 120 and the top panel 370 can couple the outer element or shade 110, inner element or shade 130, and/or a combination thereof. Thus, the bottom panel 120 and/or the top panel 370 can at least in part define the shapes of the outer element or shade 110 and/or inner element or shade 130. For example, the bottom panel 120 and the top panel 370 can have substantially the same shapes and profiles that couple the outer element or shade 110 and/or the inner element or shade 130.

More specifically, the bottom panel 120 can have a substantially circular outer profile 121*a* and a substantially circular inner profile 121*b* (FIG. 1B). Similarly, the top panel 370 can have substantially circular outer and inner profiles (not shown). Consequently, when coupled to the bottom panel 120 and top panel 370, the side panels 111 can form substantially cylindrical or ring-shaped outer and inner elements 110, 130.

It should be noted, however, that the inner and/or outer profiles of the bottom (121*a*, 121*b*) and top (not shown) panels 120, 370, respectively, can vary from one implementation to another. For example, the outer profile of the top panel 370 can be larger than the outer profile 121*a* of the bottom panel 120. Accordingly, when coupled to the bottom panel 120 and/or top panel 370, the side panels 111 can form an outer element or shade 110 with a conical shape (tapering downward from the top panel 370 toward the bottom panel 120). Moreover, the bottom panel 120 and/or the top panel 370 can have essentially any suitable shape that can allow the manufacturer to couple the side panels 111 to the bottom panel 120 and/or to the top panel 370 in a manner that shapes the outer element or shade 110 and/or the inner element or shade 130.

As mentioned above, the side panels 111 can couple together, thereby forming the outer element or shade 110 and/or inner element or shade 130, while the bottom panel 120 and/or top panel 370 can further define the shapes of the outer element or shade 110 and/or inner element or shade 130. In one implementation, the side panels 111 can have opposing flanges that can couple one side panel 111 to another side panel 111. For example, as illustrated in FIG. 3A, the side panels 310*a* and 310*b* can have opposing flanges 312 (such as flanges 312*a* and 312*b*). To form the flanges 312, a manufacturer can score a line along the inner surface of a side panel 310 and then cold form the flange by bending the side panel 310 along the score. The flanges 312 can have one or more perforations (such as perforation 212 illustrated in FIG. 2A, which can allow the manufacturer to permanently or temporarily couple the side panels 210 together or to segment end member or bulk head 209 (e.g., with one or more corresponding fasteners, such as screws, nut and bolt combinations, rivets)). As illustrated in FIG. 2A, the side panels 210 (and their corresponding flanges) can bend in a manner that forms an inner and/or outer element or shade. In other words, the outer surfaces of the side panels 210 can face outward, while the corresponding flanges 212 can bend or face inward, thereby forming the inner and/or outer element or shade.

Returning to FIG. 1B, in at least one implementation, an adhesive or a solvent can couple one or more of the flanges of the side panels 111 together or to segment end member or bulk head 209 (see e.g., FIG. 2A). Furthermore, an adhesive or solvent can couple the inner and/or outer element or shade (or side panels 111 thereof) to the top and/or bottom portions or panels. For example, the manufacturer can solvent weld the flanges together using WELD-ON for acrylics or another suitable solvent. Optionally, the manufacturer can temporarily secure the flanges of the side panels 111 together with fasteners, as described above. Subsequently, the manufacturer can inject a welding solvent (e.g., a solvent that can partially dissolve thermoplastic flanges, thereby bonding the flanges together after solidification). After the flanges are coupled or bonded together, the manufacturer can remove the fasteners from the flanges. In still further implementations, the manufacturer can use a combination of adhesive and solvent bonding to secure the flanges together. In any event, in one or more implementations the manufacturer can couple side panels 111 together to from outer and inner elements without any (permanent and/or temporary) hardware.

As mentioned above, absence of certain panel hardware or components within the lighting fixture can provide a pleasing aesthetic. For instance, as illustrated in FIG. 3A, the outer element or shade 310 can have side panels 310*a*, 310*b* coupled together at interface 306 without any hardware adjacent to flanges 312. Notably, such coupling eliminates hardware that otherwise can be visible to the viewer.

The upper and/or lower panels can couple to the outer and/or inner elements in the same or similar manner as described above in connection with the flanges of the side panels. More specifically, the manufacturer can bond the upper and lower panels to the inner and/or outer elements of the lighting fixture. For example, the manufacturer can use an adhesive, solvent, or a combination thereof. Consequently, similar to the side panels, the manufacturer can avoid using any hardware in the connections between the upper and lower panels and the inner and/or outer elements. Hence, the viewer may see no hardware components within the light-weight lighting fixture.

In one or more implementations, the upper and/or lower panels can have a slot that at least partially follows the outer and/or inner profiles thereof. Thus, the side panels that form the outer and/or inner elements can fit into such slot. Similarly, the side panels or segment end members that form at least part of the interface can abut the slot on the upper and lower panels. Accordingly, the manufacturer can locate the outer and/or inner elements relative to the upper and lower panels at predetermined positions. For instance, the upper and lower panels can couple to the outer element such that the outside surface of the outer element is flush with the outer profile of the upper and lower panels.

It should be appreciated, however, that the particular relationship between the upper and lower panels and the outer and inner elements, etc. can vary from one implementation to the other. Accordingly, in at least one implementation, at least a portion of the lower panel can protrude past the outer element, and vice versa. Likewise, a portion of the upper panel can protrude past the outer element, and vice versa. In any event, the lighting fixture can have an outer element secured to the lower panel, thereby concealing a light source or element.

Additionally, the upper and/or lower panels can include a groove that at least partially follows the outer and/or inner profiles thereof. The groove can act as a guide or pathway for placing solvent, adhesive, or glue.

One will appreciate in light of the disclosure herein that solvent welding can provide a significant advantage over other connection attachment methods in certain implementations requiring a more permanent coupling. For example, some glue and other adhesives can leave visible traces that are un-aesthetically pleasing, particularly when the lighting fixture is lit. Furthermore, hardware can also have unappealing aesthetic effects. Solvent welding on the other hand can provide a strong bond, while leaving no visible effects.

One or more implementations of the present disclosure can use an adhesive to bond side panels to the bottom and/or top panels, while avoid some or all un-aesthetically pleasing visible traces of the adhesive. For example, the manufacturer can use latex gloves or other techniques to prevent contamination or blooming of the adhesive.

In one or more implementations, the adhesive used to bond the side panels to the bottom and/or top panels can comprise a cyanoacrylate instant adhesive. More particularly, the adhesive can also optionally comprise a low viscosity adhesive. Low viscosity adhesives can allow a manufacturer to apply the adhesive between the side panels and the bottom/top panels using a capillary action. For example, the manufacturer can abut the side panels against the top/bottom panel and then apply the low viscosity adhesive to the interface/seam of the side and top/bottom panels using a needle or other delivery mechanism. The low viscosity adhesive or a self-wicking adhesive can then flow between the side and top/bottom panels using a capillary action. The adhesive can then bond the side and top/bottom panels together.

As noted above, the lighting fixture can incorporate a single or multiple lighting elements. For example, as illustrated in FIGS. 3A and 3B, the lighting fixture can have a top panel that has multiple openings, which can provide access to lighting elements (e.g., incandescent light bulbs, cfl bulbs, LEDs, string lights) located within the channel or passageway (i.e., cavity 380) of the lighting fixture 300. The manufacturer or user can secure or change the lighting elements during the assembly of the lighting fixture as well as after the deployment thereof into service. In at least one implementation, the top panel also can include one or more removable covers or lids that can selectively close the openings. A more detailed description of the top panel is given above in reference to FIGS. 5A-5D.

Additionally, mounting elements can couple to the top panel or other portion, element, feature, or component of the lighting fixture. In one or more implementations, the mounting element(s) can comprise one or more cables that can secure the lighting fixture to the support surface or structure, such as a ceiling, illustratively. Alternatively, the mounting elements can be substantially rigid, which, for example, can allow the installer to secure the lighting fixture to a vertical support surface, such as a wall, illustratively. In any event, the mounting elements can have a desired rigidity and flexibility, which can vary from one implementation to another, and which can allow the installer to secure the lighting fixture to a desired support surface or structure.

Figure 9:
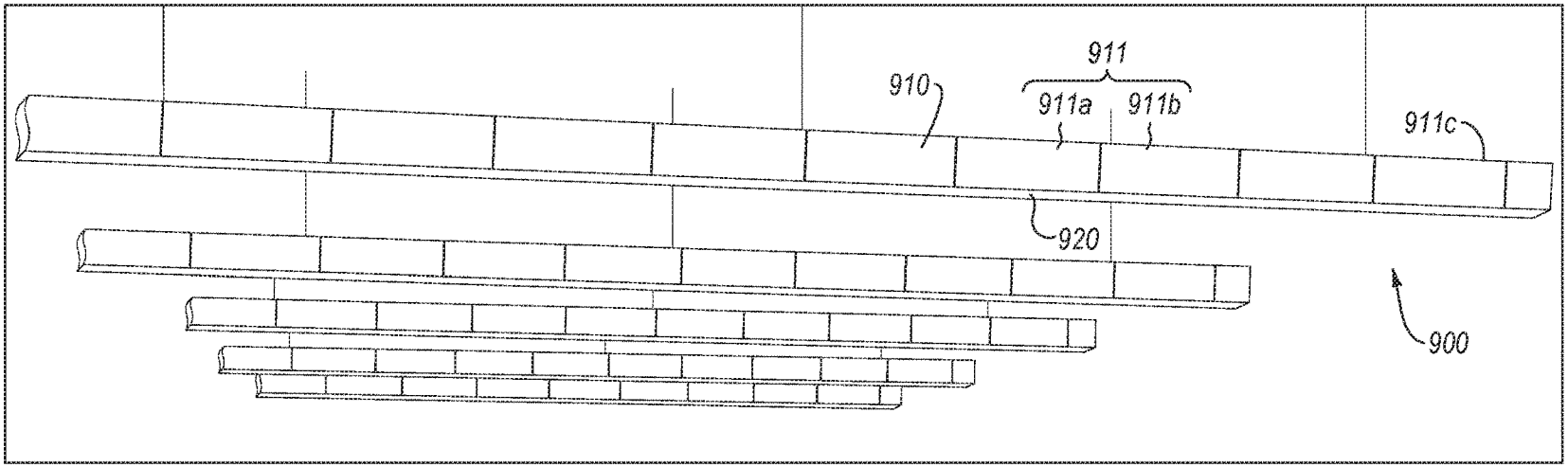
FIG. 9 illustrates a bottom perspective view of an arrangement of lighting fixtures in accordance with another implementation of the present disclosure.

As mentioned above, the particular shape of the lighting fixture can vary and may depend on the particular space or area to be illuminated, architectural and/or aesthetic preferences, as well as other aesthetic and practical considerations. For instance, as illustrated in FIG. 9, a lighting fixture 900 can have a substantially rectangular or a beam-like shape. Except as otherwise described herein, the lighting fixture 900 can be substantially the same as the lighting fixture 100 (FIGS. 1A-1C) or any other lighting fixture described herein.

For instance, the lighting fixture 900 can include an outer element or shade 910 that can have a substantially rectangular shape. Likewise, a bottom panel 920 can have a substantially rectangular outer profile or shape. Hence, the bottom panel 920 can couple to the outer element or shade 910 and can at least in part define the shape of the lighting fixture 900.

The manufacturer can form the outer element or shade 910 from multiple side panels 911 (e.g., side panels 911*a*, side panels 911*b*). The side panels 911 used for the outer element or shade 910 can be substantially the same as the side panels 111 used in the outer element or shade 110 (FIGS. 1A-1B). Additionally, however, the manufacturer can cold form the side panel 911*c* to form a corner of the outer element or shade 910 (or terminal end of lighting fixture 900) using a scored line as described above.

In some implementations, a lighting fixture can be configured to display reduced visibility of support, connecting, and/or mounting hardware components. For example, at the junction site between lighting modules of a modular lighting assembly, or between first and second ends of a wrap-around lighting fixture, support hardware can be positioned such that visibility of the hardware is reduced when the lighting fixture is illuminated. Specifically, the hardware can be positioned within corresponding recesses at the respective coupling ends of the connected lighting modules or wrap-around fixture. In at least one implementation, the outer element can be folded over or wrapped around the respective outer edges of the coupling ends and partially into the area or region of the junction site adjacent to the support hardware. The support hardware and the connective seams between the wrapped outer edges at the junction between coupling ends of lighting modules or the wrap-around fixture may thus be de-emphasized when adjacent lighting elements are activated.

CONCLUSION

Thus, implementations of the present disclosure may provide lighting fixtures that help magnify the aesthetic features of certain materials included therein, while reducing or otherwise de-emphasizing certain un-appealing features thereof. For example, one or more implementations of the present disclosure can include resin-based lighting fixtures that reduce or eliminate the visibility of seams and/or hardware, thus enhancing the illuminated and/or display surfaces thereof. Additionally, one or more implementations can include unique, aesthetically pleasing, resin-based lighting fixtures that are cost effective to produce, manufacture, and/or display, as well as methods of forming the same. Such lighting fixtures can be both light weight and structurally sound.

Furthermore, implementations of the present disclosure allow for so called just-in-time manufacturing of lighting fixtures and/or modules thereof. Likewise, some implementations allow for (large) modular lighting fixtures and/or assemblies thereof to be manufactured, stored, and/or shipped, etc. as a plurality of compatible modules of various shapes, sizes, dimensions, and curvatures, etc. Such modules can be custom-selected for incorporation into a custom-designed lighting fixture or assembly and shipped in manageable and easily handled modules instead of bulky, and often delicate, assembled structures. Thus, manufacturers and assemblers alike may save time and money by using, incorporating, and/or applying the products, apparatus, methods, and systems described herein.

The present disclosure can be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

We claim:

1. A lighting fixture, comprising:

a bottom portion;

an outer element coupled to the bottom portion; and at least one seam comprising a connective junction between first and second ends of the lighting fixture, wherein visibility of the seam from at least one vantage point is reduced when the lighting fixture is illuminated;

wherein the bottom portion comprises at least one notch disposed at the connective junction, a portion of the outer element being disposed in the notch.

2. The lighting fixture of claim 1, wherein the at least one seam comprises a connective junction between a first end of the outer element and a second end of the outer element.

3. The lighting fixture of claim 2, wherein the first end is opposite the second end, the outer element comprising a unitary panel wrapped around the lighting fixture such that the first end is disposed adjacent to the second end.

4. The lighting fixture of claim 1, wherein:

the outer element comprises a plurality of outer panels;

the at least one seam comprising a connective junction between a first end of a first bottom panel and a first end of a second bottom panel.

5. The lighting fixture of claim 1, wherein the bottom portion comprises a plurality of bottom panels, the at least one seam comprising a connective junction between a first end of a first bottom panel and a first end of a second bottom panel.

6. The lighting fixture of claim 1, wherein the bottom portion comprises a translucent lighting diffuser.

7. The lighting fixture of claim 1, wherein the outer element comprises an opaque lighting shade.

8. The lighting fixture of claim 1, further comprising one or more lighting elements connected to the lighting fixture.

9. A lighting fixture comprising a plurality of connected lighting modules, the plurality of connected lighting modules each comprising:

a bottom portion having a first end, an opposing second end, an outer side edge extending from the first end to the opposing second end, and an inner side edge opposite the outer side edge and extending from the first end to the opposing second end, the bottom portion comprising a bottom panel;

a first end piece connected to and extending from the bottom portion, the first end piece having an outer end face aligned with the first end of the bottom portion, an outer side face aligned with the outer side edge of the bottom portion, and an inner side face aligned with the inner side edge of the bottom portion;

an outer side element coupled to the outer side edge of the bottom portion and the outer side face of the first end piece, the outer side element extending between the first and second ends of the bottom portion; and an inner side element coupled to the inner side edge of the bottom portion and the inner side face of the first end piece, the inner side element extending between the first and second ends of the bottom portion, at least one seam comprising a connective junction between respective bottom portions, outer side elements, and inner side elements of first and second lighting modules connected at respective first end pieces thereof;

wherein the connected first and second lighting modules each comprise:

an upper portion having a first end connected to and extending from the first end piece to an opposing second end thereof, an outer side edge connected to the outer side element and extending from the first end to the opposing second end, and an inner side edge connected to the inner side element and extending from the first end to the opposing second end.

10. The lighting fixture of claim 9 wherein the plurality of connected lighting modules each comprise:

a first recess in the first end of the bottom portion extending from the outer side edge thereof;

a second recess in the first end of the bottom portion extending from the inner side edge thereof;

a first recess in the outer end face of the first end piece extending from the outer side face thereof; and a second recess in the outer end face of the first end piece extending from the inner side face thereof;

a portion of the outer side element being disposed in the first recess in the first end of the bottom portion and in the first recess in the outer end face of the first end piece, and a portion of the inner side element being disposed in the second recess in the first end of the bottom portion and in the second recess in the outer end face of the first end piece, such that:

the respective portions of the outer side element disposed in the first recess in the first end of the bottom portion and in the first recess in the outer end face of the first end piece of the connected first and second lighting modules;

the respective portions of the inner side element disposed in the second recess in the first end of the bottom portion and in the second recess in the outer end face of the first end piece of the connected first and second lighting modules; and the respective outer end faces of the first end piece of the connected first and second lighting modules, are in flush contact.

11. The lighting fixture of claim 9, wherein:

at least one of the plurality of connected lighting modules further comprises a second end piece connected to and extending from the bottom portion;

has an outer end face aligned with the second end of the bottom portion, an outer side face aligned with the outer side edge of the bottom portion, and an inner side face aligned with the inner side edge of the bottom portion;

the outer side element is further coupled to the outer side face of the second end piece; and the inner side element is further coupled to the inner side face of the second end piece.

12. The lighting fixture of claim 11, wherein at least one of the plurality of connected lighting modules further comprises:

a first recess in the second end of the bottom portion extending from the outer side edge thereof;

a second recess in the second end of the bottom portion extending from the inner side edge thereof;

a first recess in the outer end face of the second end piece extending from the outer side face thereof; and a second recess in the outer end face of the second end piece extending from the inner side face thereof;

a portion of the outer side element being disposed in the first recess in the second end of the bottom portion and in the first recess in the outer end face of the second end piece, and a portion of the inner side element being disposed in the second recess in the second end of the bottom portion and in the second recess in the outer end face of the second end piece, such that:

the respective portions of the outer side element disposed in the first recess in the second end of the bottom portion and in the first recess in the outer end face of the second end piece of the connected first and second lighting modules;

the respective portions of the inner side element disposed in the second recess in the second end of the bottom portion and in the second recess in the outer end face of the second end piece of the connected first and second lighting modules; and the respective outer end faces of the second end piece of the connected first and second lighting modules, are in flush contact.

13. The lighting fixture of claim 9, wherein at least one of the plurality of connected lighting modules further comprises an outer end element connected to the second end of the bottom portion and extending between the outer side element and the inner side element at the second end of the bottom portion.

14. The lighting fixture of claim 9, further comprising:

a mounting element, a portion of the mounting element being disposed between the respective first end pieces of the connected first and second lighting modules;

wherein visibility of the portion of the mounting element disposed between the respective first end pieces from at least one vantage point is reduced when the lighting fixture is illuminated.

15. The lighting fixture of claim 14, wherein the respective first end pieces of the connected first and second lighting modules each comprises:

one or more mounting element receiving recesses disposed in the respective outer end faces thereof, wherein a portion of the mounting element is disposed in the one or more mounting element receiving recesses, such that the respective outer end faces of the first end piece of the connected first and second lighting modules are in flush contact.

16. The lighting fixture of 9, wherein:

the upper portion comprises an opening configured for receiving a lighting assembly;

the connected first and second lighting modules each comprises a lighting assembly connected to the upper portion; and the lighting assembly has an electrical connection element coupled to an electrical connection element of the upper portion.

17. The lighting fixture of claim 9, wherein the respective first end pieces of the first and second lighting modules are coupled together via one or more fasteners.

18. The lighting fixture of claim 17, wherein the one or more fasteners extend through one or more openings in the respective first end pieces of the first and second lighting modules.

19. The lighting fixture of claim 9, wherein:

the lighting fixture comprises a ring-shaped structure;

the plurality of connected lighting modules comprising arc-shaped sections of the ring-shaped structure;

the respective bottom portions and outer elements of the plurality of connected lighting modules comprising curved configurations.

20. The lighting fixture of claim 9, wherein at least a portion of the lighting fixture comprises a rectangular, tubular configuration, the plurality of connected lighting modules comprising rectangular, tubular sections thereof.

21. The lighting fixture of claim 9, wherein the lighting fixture comprises a wrap-around and enclosed configuration.

22. A lighting fixture comprising a plurality of connected lighting modules, the plurality of connected lighting modules each comprising:

a bottom portion having a first end, an outer side edge extending from the first end, and an inner side edge opposite the outer side edge and extending from the first end;

a first end piece connected to and extending from the bottom portion, the first end piece having an outer end face aligned with the first end of the bottom portion, an outer side face aligned with the outer side edge of the bottom portion, and an inner side face aligned with the inner side edge of the bottom portion;

an outer side element coupled to the outer side edge of the bottom portion and the outer side face of the first end piece, the outer side element extending from the first end of the bottom portion; and an inner side element coupled to the inner side edge of the bottom portion and the inner side face of the first end piece, the inner side element extending from the first end of the bottom portion, the at least one seam comprising a connective junction between respective bottom portions, outer side elements, and inner side elements of connected first and second lighting modules;

wherein at least one of the plurality of connected lighting modules comprises a branched configuration such that the bottom portion further comprises a second end and at least a third end.

* * * * *